US009411293B2

(12) United States Patent
Nakajima et al.

(10) Patent No.: US 9,411,293 B2
(45) Date of Patent: Aug. 9, 2016

(54) IMAGE FORMING APPARATUS WITH AUTOMATIC DOCUMENT FEEDER

(71) Applicant: CANON KABUSHIKI KAISHA, Tokyo (JP)

(72) Inventors: Yuki Nakajima, Numazu (JP); Masaru Aoki, Numazu (JP); Hiroto Endo, Hadano (JP); Daisuke Kaneko, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/029,089

(22) Filed: Sep. 17, 2013

(65) Prior Publication Data

US 2014/0079457 A1 Mar. 20, 2014

(30) Foreign Application Priority Data

Sep. 19, 2012 (JP) ..... 2012-205856

(51) Int. Cl.
*G03G 15/23* (2006.01)
*B65H 15/00* (2006.01)
*G03G 15/00* (2006.01)

(52) U.S. Cl.
CPC ..... *G03G 15/607* (2013.01); *G03G 15/6529* (2013.01); *G03G 2215/00599* (2013.01); *G03G 2215/00928* (2013.01)

(58) Field of Classification Search
CPC ..... G03G 2215/00928; G03G 2215/00177; G03G 15/6529; G03G 15/23; H04N 1/0461; H04N 1/00586; H04N 1/00572; H04N 1/00575; H04N 1/00578; H04N 1/0058; H04N 1/00596
USPC ..... 399/363, 374
See application file for complete search history.

(56) References Cited

U.S. PATENT DOCUMENTS

| | | | | | |
|---|---|---|---|---|---|
| 5,369,480 | A * | 11/1994 | Isobe | 358/401 |
| 5,384,631 | A * | 1/1995 | Matsunami | 399/370 |
| 6,421,509 | B1 * | 7/2002 | Nomura et al. | 399/81 |
| 7,376,382 | B2 * | 5/2008 | Shibata | 399/401 |
| 2004/0126122 | A1 * | 7/2004 | Kanamoto et al. | 399/20 |
| 2006/0145414 | A1 * | 7/2006 | Yokobori et al. | 271/258.01 |
| 2009/0279149 | A1 * | 11/2009 | Chen et al. | 358/498 |

FOREIGN PATENT DOCUMENTS

| | | | | |
|---|---|---|---|---|
| JP | 2000-185881 A | | 7/2000 | |
| JP | 2006016201 A | * | 1/2006 | B65H 29/60 |
| JP | 2006-232467 A | | 9/2006 | |
| JP | 2006232467 A | * | 9/2006 | B65H 85/00 |
| JP | 2007-033817 A | | 2/2007 | |
| JP | 2011-114845 A | | 6/2011 | |

* cited by examiner

*Primary Examiner* — Blake A Tankersley
*Assistant Examiner* — Ruben Parco, Jr.
(74) *Attorney, Agent, or Firm* — Canon USA, Inc. IP Division

(57) ABSTRACT

An image forming apparatus performs control to parallelly achieve document image reading by a reading unit and image formation by an image forming unit for forming on a recording material a document image read by the reading unit.

9 Claims, 23 Drawing Sheets

ORDER OF CONVEYANCE OF DOCUMENT SHEETS AND RECORDING MATERIALS TO COMMON CONVEYANCE PATH 85 IN PROCESS OF TWO-SIDED FEEDING-READING OF N DOCUMENT SHEETS AND TWO-SIDED PRINTING ON N RECORDING MATERIALS

ORDER OF CONVEYANCE OF DOCUMENT SHEETS AND RECORDING MATERIALS TO COMMON CONVEYANCE PATH 80 IN PROCESS OF TWO-SIDED FEEDING-READING OF N DOCUMENT SHEETS AND TWO-SIDED PRINTING ON N RECORDING MATERIALS

IMAGE FORMING APPARATUS WITH AUTOMATIC DOCUMENT FEEDER

BACKGROUND OF THE INVENTION

1. Field of the Invention

The present invention relates to a document reading apparatus, such as an automatic document feeder (ADF) unit, and an image forming apparatus such as a copying machine and a laser beam printer provided with the ADF unit.

2. Description of the Related Art

With a conventional image forming apparatus of this type, a document conveyance path for conveying a document to a document reading unit, and a recording material conveyance path for conveying a recording material to an image forming unit are configured independently of each other. More specifically, a sheet feed unit, guide members forming a predetermined conveyance path, a plurality of conveyance rollers, a motor for driving conveyance rollers, and a sheet discharge unit are disposed separately for each of a document and a recording material.

For this reason, it is difficult for the image forming apparatus to avoid the increase in complexity of the overall mechanical configuration, the increase in cost, and the increase in size. To solve these problems, for example, Japanese Patent Application Laid-Open No. 2000-185881 discusses a technique for simplifying the configuration and reducing cost and size by using a document conveyance path and a recording material conveyance path as common conveyance paths. A document reading unit is disposed in the recording material conveyance path ranging from a sheet feed unit to a sheet discharge unit.

However, in an image forming apparatus discussed in Japanese Patent Application Laid-Open No. 2000-185881, the document reading unit is disposed in the recording material conveyance path, for example, between a fixing device and the sheet discharge unit. Therefore, there has been a problem that, during a document reading operation during which a document exists in the recording material conveyance path, the printing operation for a recording material is suspended, resulting in degraded productivity of the image forming apparatus.

Further, in a case where a plurality of document sheets is read and printed on a plurality of recording materials with the configuration discussed in Japanese Patent Application Laid-Open No. 2000-185881, alternately performing the document reading operation and the printing operation will degrade the productivity of recording material printing because of the above-described reason. To avoid this problem, the document reading operation may be performed for all of document sheets prior to the printing operation for recording materials. In this case, however, sufficient printing productivity cannot be obtained. Further, a high-capacity image memory is required to store all of image data after the document reading operation, resulting in a cost increase.

SUMMARY OF THE INVENTION

The present invention is directed to an image forming apparatus capable of preventing degradation of the productivity in a case where a document reading operation and a printing operation are performed in parallel.

According to an aspect of the present invention, to solve the above-described problem, the image forming apparatus includes an image forming unit configured to form an image on a recording material, a conveyance path configured to convey the recording material having the image formed thereon by the image forming unit, and reverse the recording material, a reading unit configured to read an image of a document sheet conveyed from a document sheet feed unit to the conveyance path, and a control unit configured to perform control to parallelly achieve document image reading by the reading unit and image formation by the image forming unit for forming on a recording material the document image read by the reading unit. The control unit controls timing for starting document sheet conveyance from the document sheet feed unit so that document sheets and recording materials are alternately conveyed in the conveyance path.

According to another aspect of the present invention, the image forming apparatus includes an image forming unit configured to form an image on a recording material, a conveyance path configured to convey the recording material having the image formed thereon by the image forming unit, and reverse the recording material, a reading unit configured to read an image of a document sheet conveyed from a document sheet feed unit to the conveyance path, and a control unit configured to perform control to parallelly achieve document image reading by the reading unit and image formation by the image forming unit for forming on a recording material the document image read by the reading unit. The control unit controls timing for reversing recording material for conveying to the conveyance path the recording material having the image formed thereon by the image forming unit so that document sheets and recording materials are alternately conveyed in the conveyance path.

Further features of the present invention will become apparent from the following detailed description of exemplary embodiments with reference to the attached drawings.

DESCRIPTION OF THE EMBODIMENTS

Exemplary embodiments of the present invention will be described in detail below.

<Image Forming Process Performed in Image Forming Apparatus>

Figure 1A:
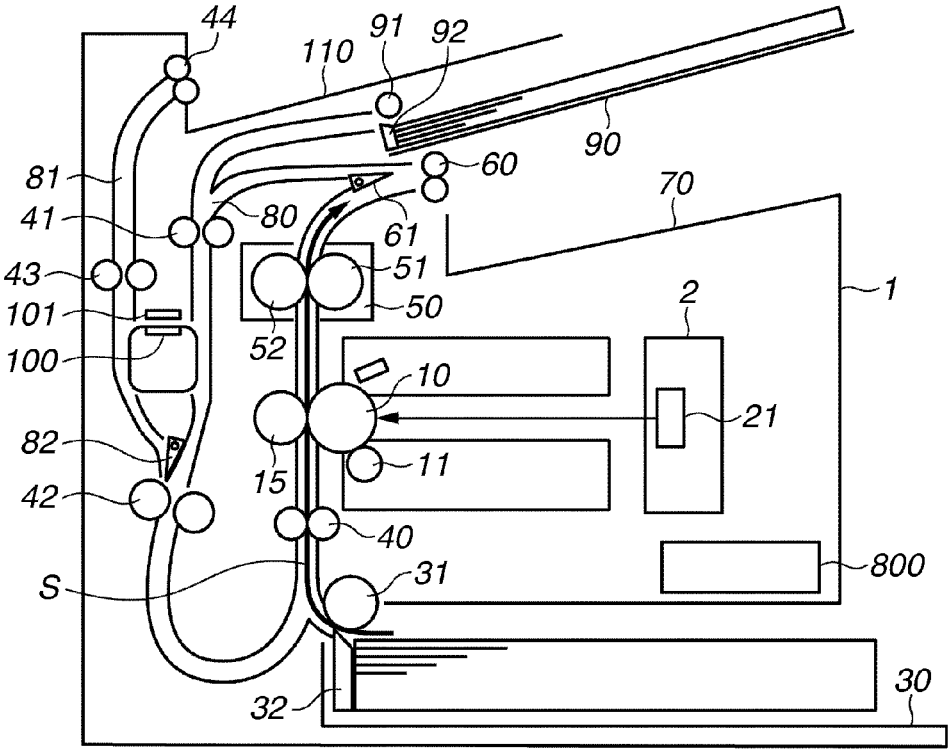
FIGS. 1A and 1B are cross sectional views illustrating a configuration and a two-sided printing process of an image forming apparatus according to a first exemplary embodiment of the present invention.

First of all, an image forming process will be described. FIG. 1A is a cross sectional view illustrating an image forming apparatus 1 according to a first exemplary embodiment. Referring to FIG. 1A, the image forming apparatus 1 includes a rotatable photosensitive drum 10 as an image bearing member, and a developing roller 11 that rotates while holding toner, in contact with the photosensitive drum 10. The photosensitive drum 10 and the developing roller 11 are disposed at the center of the image forming apparatus 1. Upon reception of an image forming instruction, a light emitting unit 21 included in an optical unit 2 irradiate the surface of the rotating photosensitive drum 10 with a laser beam. A charge-based latent image is formed on the surface of the photosensitive drum 10 which has been irradiated with a laser beam. When the developing roller 11 applies the toner held thereon to the latent image formed on the surface of the photosensitive drum 10, development is performed and a toner image is formed on the surface of the photosensitive drum 10.

A plurality of recording materials S is stored in a first sheet feed unit 30 (first sheet feed unit). The plurality of recording materials S is conveyed one by one in a conveyance path for image formation (first conveyance path), configured between a conveyance roller pair 40 and a discharge roller pair 60, and then subjected to image formation. Upon reception of an image forming instruction, the plurality of recording materials S is conveyed one by one to the conveyance roller pair 40 by a cassette (hereinafter referred to as CST) pickup roller 31 and a separation member 32. The conveyance roller pair 40 conveys a recording material S to a transfer unit (transfer roller) 15 while adjusting the conveyance timing so that the toner image on the photosensitive drum 10 is transferred onto a predetermined position on the recording material S.

The toner image on the photosensitive drum 10 is transferred onto the recording material S by a transfer voltage and pressure applied to the transfer unit 15. Then, the recording material S is conveyed to a fixing unit 50. The fixing unit 50 applies heat and pressure to the toner image on the recording material S to fix the toner image thereon. In this case, heat is generated by a heating roller 51, and pressure is generated by a pressure roller 52 facing the heating roller 51. After the toner image has been fixed onto the recording material S, the recording material S is conveyed to the discharge roller pair 60.

Figure 1B:
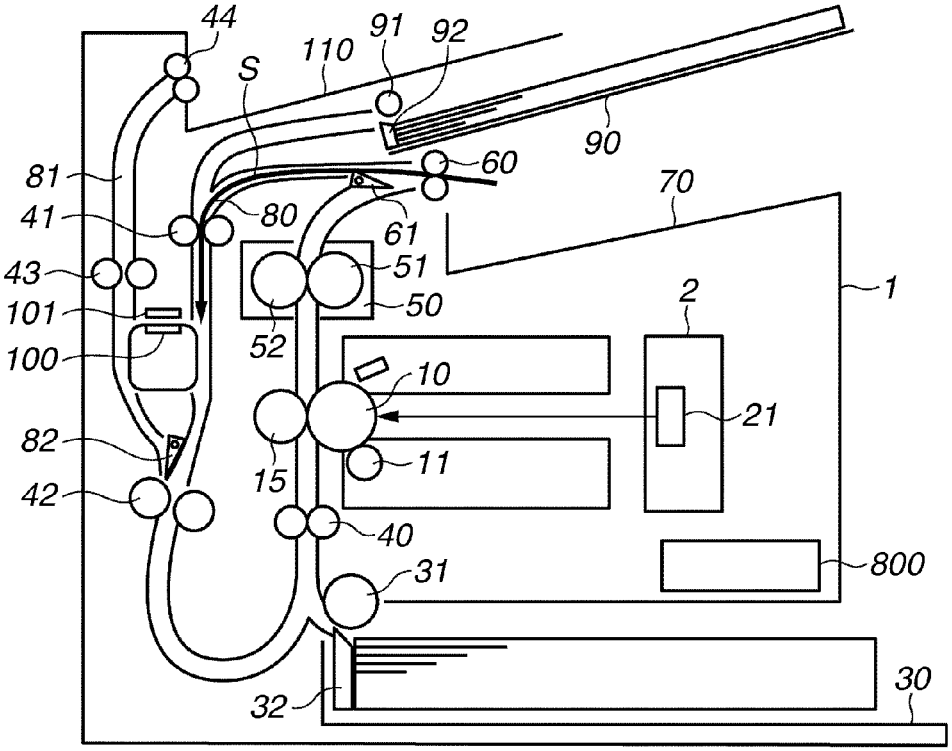

In the case of one-sided printing, the discharge roller pair 60 conveys the recording material S to the outside of the image forming apparatus 1 as it is, and the recording material S is stacked onto a first discharge unit 70. In the case of two-sided printing, the discharge roller pair 60 conveys the recording material S until the trailing edge of the recording material S in the conveyance direction (hereinafter simply referred to as "trailing edge") passes a two-sided flapper 61. Then, upon detection of the recording material S having passed the two-sided flapper 61, the two-sided flapper 61 changes the conveyance destination of the recording material S to the side of the two-sided conveyance path 80 (second conveyance path) to which both the recording material S and a document sheet G are conveyed. The discharge roller pair 60 rotates in the reverse direction to convey the recording material S to the two-sided conveyance path 80. As illustrated in FIG. 1B, the switchbacked recording material S is conveyed to a document reading unit 100 by the conveyance roller pair 41. Further, the recording material S is conveyed again to the transfer unit 15 by the conveyance roller pairs 42 and 40. At the transfer unit 15, a toner image is transferred onto the other side of the recording material S. The fixing unit 50 fixes the toner image onto the recording material S. Then, the discharge roller pair 60 discharges and stacks the recording material S onto the first discharge unit 70.

<Operations of Two-Sided Feeding-Reading of Document Sheet and Two-Sided Printing on Recording Material>

Figure 2A:
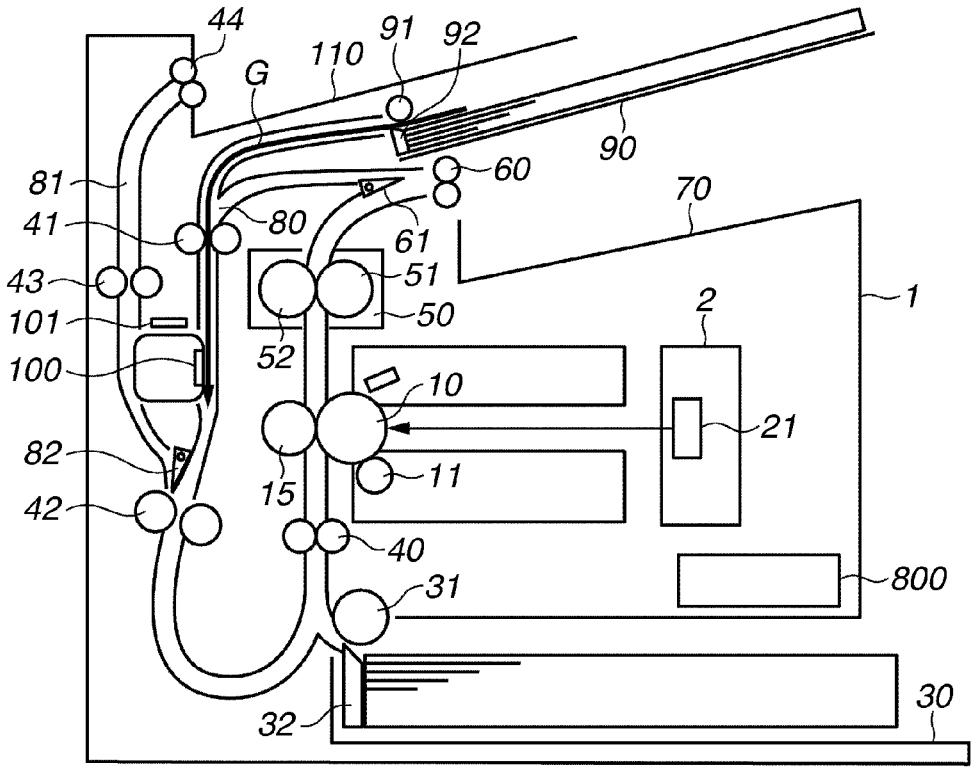
FIGS. 2A and 2B illustrate operations of two-sided reading of a document sheet and two-sided printing on a recording material according to the first exemplary embodiment.

Next, a process of reading an image of a document image and making two-sided printing on a recording material, will be described. FIG. 2A illustrates a state where reading of the front side of the document sheet G is started. A plurality of document sheets G stored in a second sheet feed unit 90 (second sheet feed unit) disposed on the upstream side of the two-sided conveyance path 80 in the conveyance direction is conveyed one by one to the conveyance roller pair 41 by a document pickup roller 91 and a separation member 92. Before the document reading unit 100 starts reading the first side (front side) of the document sheet G conveyed from the second sheet feed unit 90, the document reading unit 100 emits light to a white reference member 101, corrects the white reference value, and then rotates to face the two-sided conveyance path 80. The conveyance roller pair 41 conveys the document sheet G to the document reading unit 100. Upon detection of the leading edge of the document sheet G in the conveyance direction (hereinafter simply referred to as "leading edge"), the document reading unit 100 reads an image on the document sheet G. The image read by the document reading unit 100 is stored in an image memory 804 (described below) as document image data for the first side of the document sheet G. Referring to FIG. 2A, the white reference member 101 is disposed downward in consideration of dust adherence. Although a white reference plate is used as a reference member, the color of a reference member is not limited to white.

Figure 2B:
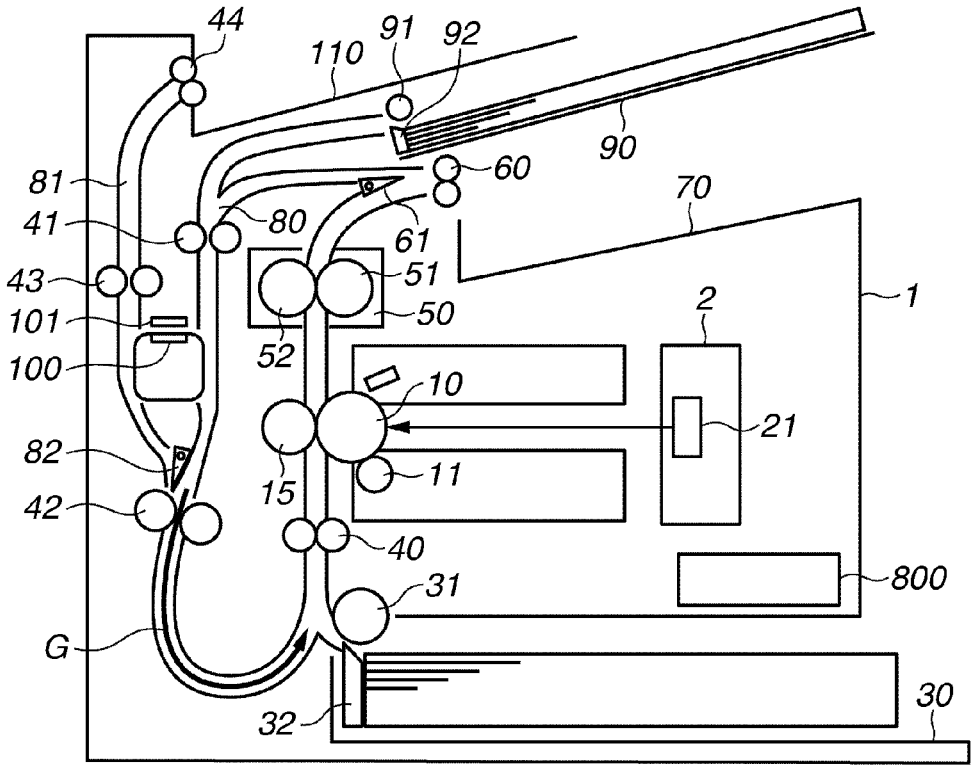

FIG. 2B illustrates a state where reading of the first side (front side) of the document sheet G is completed. After passing through the document reading unit 100, the document sheet G is conveyed to the conveyance roller pair 42. Upon detection of the trailing edge of the document sheet G having passed the switchback flapper 82, the conveyance roller pair 4 stops. Accordingly, the document sheet G is stopped while being pinched by the conveyance roller pair 42.

Figure 2C:
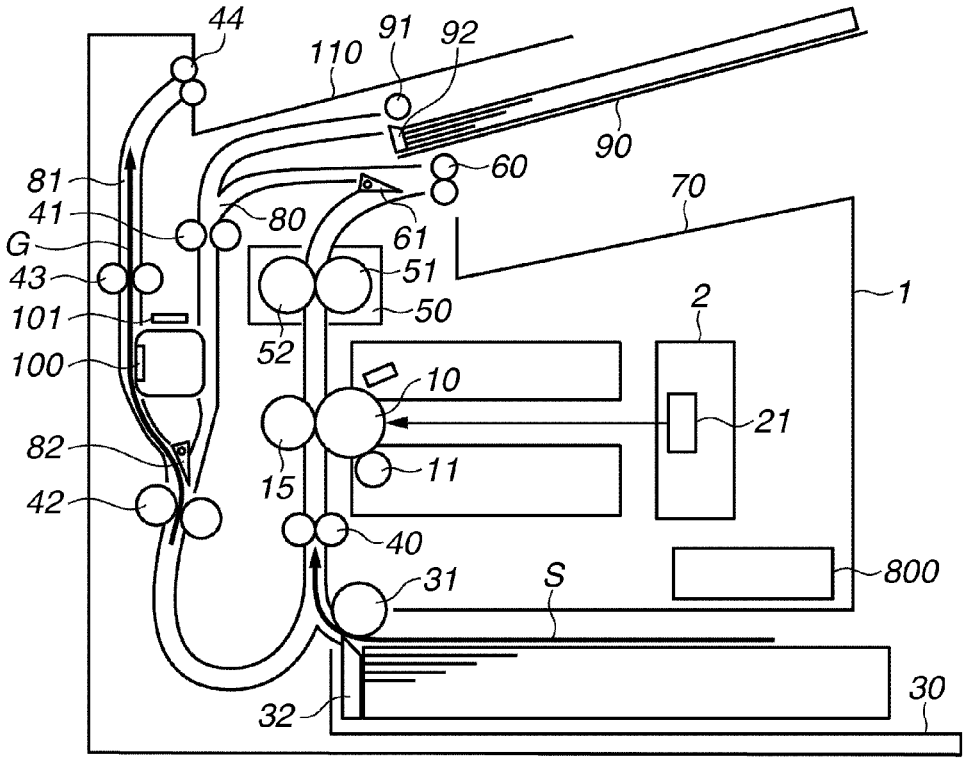
FIGS. 2C and 2D illustrate operations of two-sided reading of a document sheet and two-sided printing on a recording material according to the first exemplary embodiment.

FIG. 2C illustrates a state where the document reading unit 100 starts reading the second side (back side) of the document sheet G. When the switchback flapper 82 changes the conveyance path of the document sheet G from the two-sided conveyance path 80 to a document conveyance path 81 (third conveyance path), the document reading unit 100 rotates to face the document conveyance path 81. Then, the conveyance roller pair 42 starts rotating in the reverse direction. The document sheet G is conveyed in the opposite direction along the document conveyance path 81 to the document reading unit 100. Upon detection of the leading edge of the document sheet G, the document reading unit 100 reads an image of the second side (back side) of the document sheet G, and stores in the image memory 804 the read image as document image data for the second side of the document sheet G. When the back side of the document sheet G is not to be read, the document sheet G is conveyed in the document conveyance path 81 by the conveyance roller pairs 43 and 44, and then stacked onto the second discharge unit 110.

The plurality of recording materials S fed from the first sheet feed unit 30 is conveyed one by one to the conveyance roller pair 40. When the light emitting unit 21 irradiates the photosensitive drum 10 with a laser beam, a latent image based on the document image data for the second side (back side) of the document sheet G stored in the image memory 804 is formed on the photosensitive drum 10. Then, when the toner image formed by developing the latent image is transferred onto the recording material S at the transfer unit 15, and the recording material S is conveyed to the fixing unit 50. Thus, the image formation for the second side of the document sheet G is completed. Referring to FIG. 2C, feeding of the recording material S is started at the same time when reading of the image on the second side (back side) of the document sheet G is started. However, feeding of the recording material S may be started after reading of the image on the second side of the document sheet G is completed.

Figure 2D:
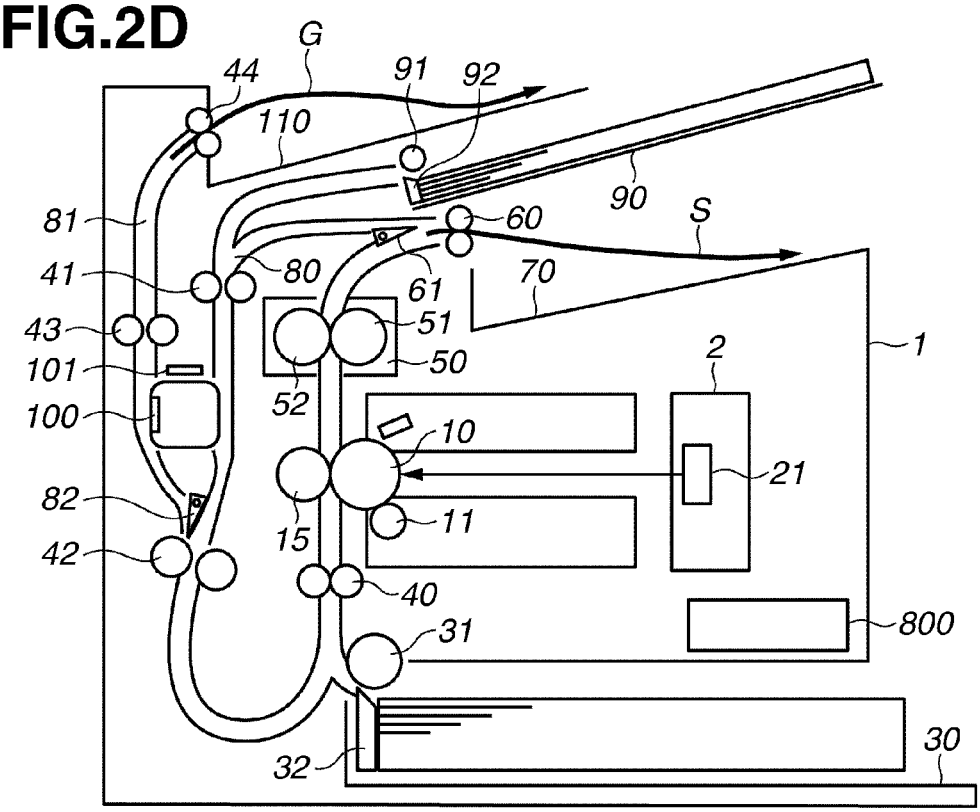

FIG. 2D illustrates a state where reading of the back side of the document sheet G is completed. Upon completion of reading the document sheet G, the document sheet G is conveyed by the conveyance roller pairs 43 and 44, and then stacked onto the second discharge unit 110. When the trailing edge of the document sheet G has passed the switchback flapper 82, the switchback flapper 82 changes the conveyance path of the recording material S from the document conveyance path 81 to the two-sided conveyance path 80 so that the recording material S currently being conveyed in the two-sided conveyance path 80 is conveyed toward the conveyance roller pair 40. Then, the discharge roller pair 60 disposed on the downstream side of the recording material S in the conveyance direction rotates in the reverse direction. The recording material S that has been completed image formation for the second side of the document sheet G is conveyed to the two-sided conveyance path 80 selected by the two-sided flapper 61.

Figure 2E:
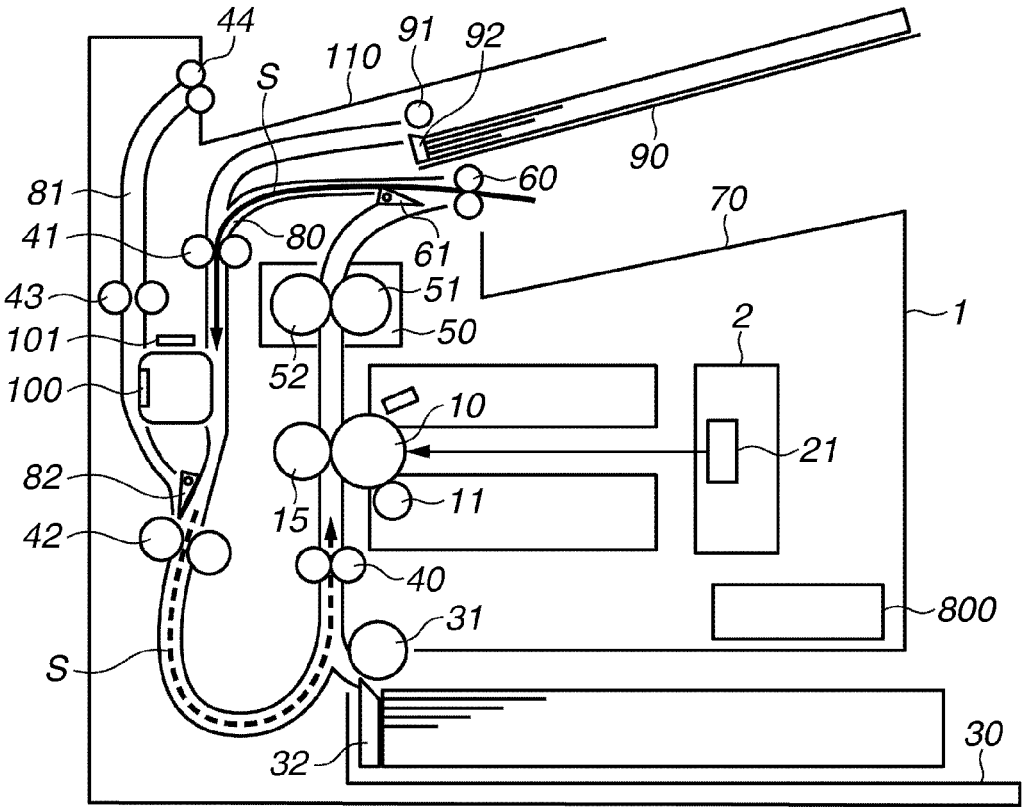
FIG. 2E illustrates operations of two-sided reading of a document sheet and two-sided printing on a recording material according to the first exemplary embodiment.

FIG. 2E illustrates a state where the recording material S is currently being conveyed to the image forming unit to be subjected to image formation for the first side of the document sheet G. The two-sided conveyance path 80 is a two-sided conveyance path for image formation on the second side of the recording material S that has been completed image formation on the first side. The recording material S conveyed in the two-sided conveyance path 80 passes the document reading unit 100, in which a sensor faces the side of the document conveyance path 81, and then is conveyed to the conveyance roller pair 42. Then, the recording material S is conveyed again to the transfer unit 15 by the conveyance roller pairs 40 and 42, as illustrated by the broken line. A toner image based on the document image data for the first side of the document sheet G stored in the image memory 804 is formed on the recording material S that completed image formation for the second side of the document sheet G. The recording material S is stacked onto the first discharge unit 70.

<Overview of Control Unit of Image Forming Apparatus>

Figure 3:
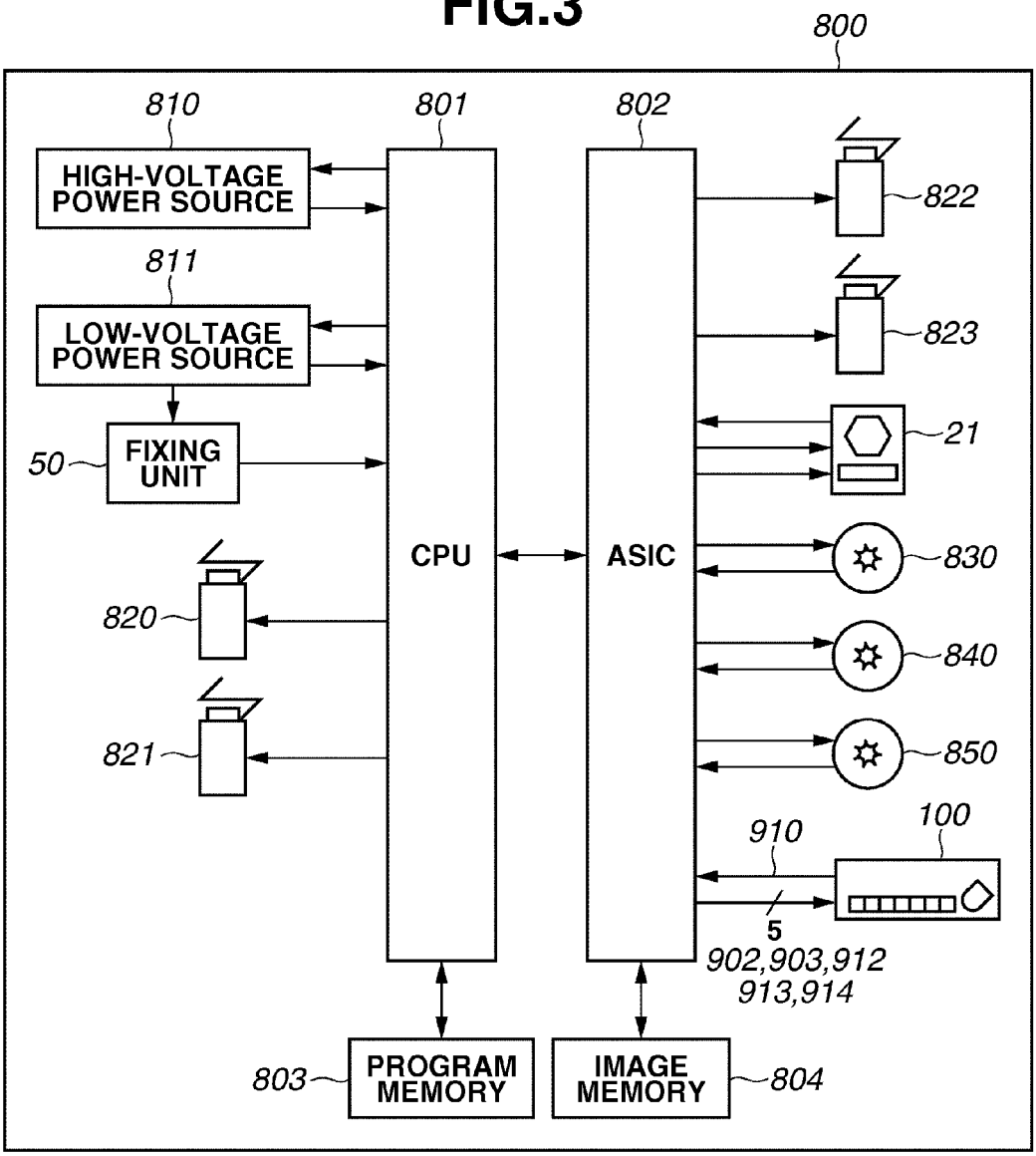
FIG. 3 is a block diagram illustrating a configuration of a control unit according to the first exemplary embodiment.

FIG. 3 is a block diagram illustrating a configuration of a control unit 800 including the CPU 801 for controlling the image forming apparatus 1. Referring to FIG. 3, a light emitting unit 21 including a rotational polygon mirror, a motor, and a laser light emitting element is connected to an application specific integrated circuit (ASIC) 802. To irradiate the photosensitive drum 10 with a laser beam to form a desired latent image, the CPU 801 outputs control signals to the ASIC 802 to control the light emitting unit 21 included in an optical unit 2. A main motor 830 drives the CST pickup roller 31, the conveyance roller pair 40, the photosensitive drum 10, the transfer unit 15, the heating roller 51, and the pressure roller 52 to convey the recording material S. When feeding rollers for feeding the recording material S are started to be driven, a CST feeding solenoid 822 is turned ON to drive the CST pickup roller 31. A two-sided drive motor 840 drives the document pickup roller 91 and the conveyance roller pairs 41 to 44. The discharge roller drive motor 850 drives the discharge roller pair 60. The CPU 801 controls drive systems, such as the main motor 830, the CST feeding solenoid 822, the two-sided drive motor 840, and the discharge roller drive motor 850 via the ASIC 802.

The CPU 801 controls a high-voltage power source 810 for controlling a charging voltage, a development voltage, and a transfer voltage required for the electrophotographic process, a low-voltage power source 811, and the fixing unit 50. The CPU 801 further detects temperature by using a thermistor (not illustrated) provided in the fixing unit 50, and performs control to maintain the temperature of the fixing unit 50 constant.

A program memory 803 is connected to the CPU 801 via a bus (not illustrated). The program memory 803 stores programs and data used by the CPU 801 to perform processing. The CPU 801 controls operations of the image forming apparatus 1 based on the programs and data stored in the program memory 803.

The ASIC 802 performs speed control for the motor in the light emitting unit 21, and speed control for the main motor 830, the two-sided drive motor 840, and the discharge roller drive motor 850 based on instructions from the CPU 801. In motor speed control, the ASIC 802 detects a tack signal (a pulse signal output from each motor each time the motor rotates), and outputs an acceleration or deceleration signal to each motor so that the tack signal is output at predetermined intervals. Performing motor control via hardware circuit, such as the ASIC 802, in this way enables reducing control load on the CPU 801.

Control operations performed by the control unit 800 at the time of printing on a recording material will be described. Upon reception of a print command for instructing printing on a recording material from a host computer (not illustrated), the CPU 801 drives the main motor 830, the two-sided drive motor 840, and the CST feeding solenoid 822 via the ASIC 802 to convey the recording material S. The toner image formed on the photosensitive drum 10 is transferred onto the recording material S at the transfer unit 15. The fixing unit 50 fixes the toner image onto the recording material S. The discharge roller pair 60 discharges the recording material S onto the first discharge unit 70 as a recording material stacking unit. To improve the alignment characteristics of recording materials, the first discharge unit 70 is provided with a gentle rising slope from the vicinity of the discharge port toward the recording material discharge direction. The CPU 801 supplies predetermined power from the low voltage power source 811 to the fixing unit 50 to cause the fixing unit 50 to generate a desired heating value to heat the recording material S so that the toner image thereon is melted and fixed onto the recording material S.

Next, control operations performed by the control unit 800 at the time of document reading will be described. Upon reception of a scanning command for instructing reading of the document sheet G from a host computer (not illustrated), the CPU 801 drives a two-sided flapper solenoid 820 and the two-sided drive motor 840 via the ASIC 802 to operate a document feeding solenoid 823. As a result, the torque of the two-sided drive motor 840 is transmitted to the document pickup roller 91, and the document sheet G is conveyed. The document reading unit 100 reads the document sheet G based on a CISSTART signal 902, a CISLED signal 903, a SI_in signal 912, a SI_select signal 913, and a SYSCLK signal 914, which are control signals output from the ASIC 802. These control signals will be described in detail below. The CPU 801 stores in the image memory 804 connected to the ASIC 802 the read document image data output as a SI_out signal 910 from the document reading unit 100 through control via the ASIC 802. Then, the CPU 801 operates the switchback solenoid 821 to turn over the switchback flapper 82 toward the side of the document conveyance path 81, and reverses the two-sided drive motor 840 to convey the document sheet G to the second discharge unit 110.

<Overview of Document Reading Unit>

Figure 4A:
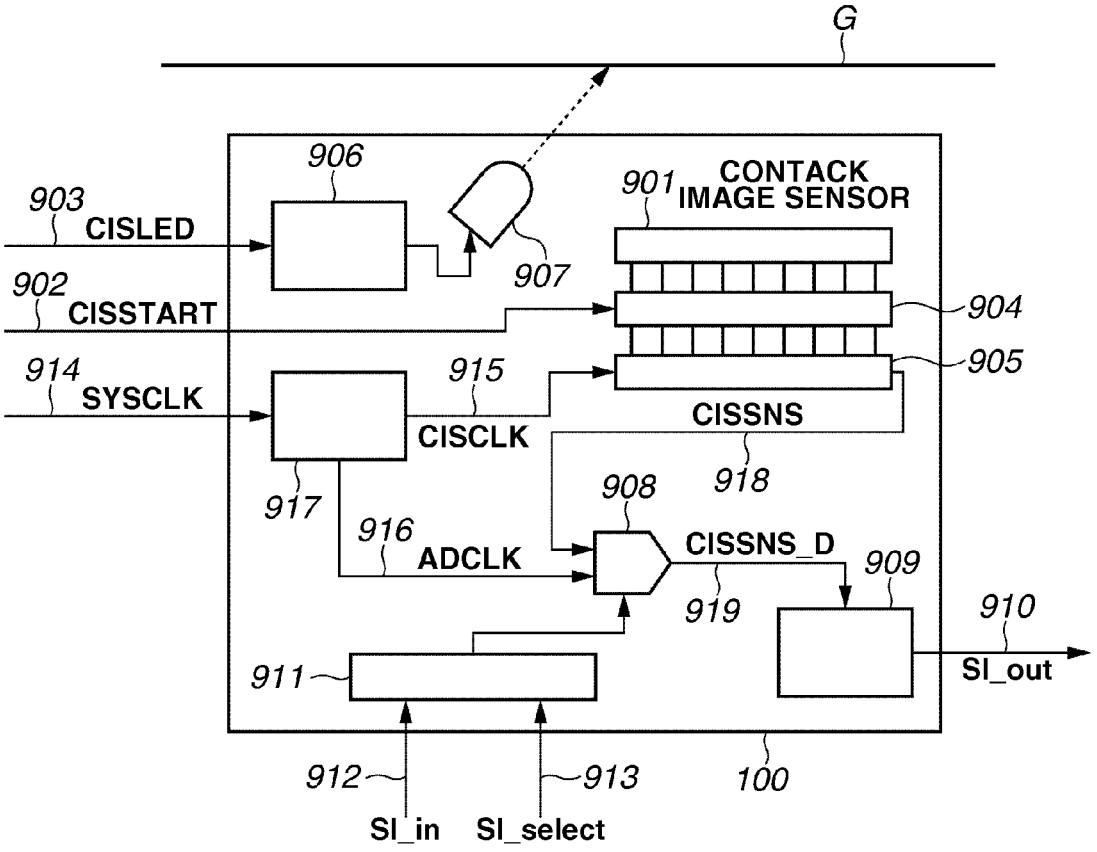
FIG. 4A is a block diagram illustrating a circuit configuration of a document reading unit according to the first to fourth exemplary embodiments.

The document reading unit 100 will be described in detail with reference to FIG. 4A. FIG. 4A is a circuit block diagram of the document reading unit 100. Referring to FIG. 4A, a contact image sensor (CIS) unit 901 includes, for example, photo diodes including 10,368 pixels arranged in array form with a certain main scanning density (for example, 1200 dots per inch (dpi)). The CISSTART signal 902 is a document reading start pulse signal input to the CIS sensor unit 901. The CISLED signal 903 is a control signal for controlling a light emitting element 907. A current amplifier unit 906 controls the current to be supplied to the light emitting element 907 based on the CISLED signal 903. The light emitting element 907 uniformly irradiates the document sheet G. A timing generator 917 receives the SYSCLK signal 914, and generates an ADCLK signal 916 and a CISCLK signal 915. The SYSCLK signal 914 is a system clock for determining the operation speed of the document reading unit 100. The ADCLK signal 916 is a sampling clock for determining the sampling rate of an analog-to-digital (A/D) converter 908. The CISCLK signal 915 is used as a transfer clock for a CISSNS signal 918 which is an output signal of a shift register 905.

Next, the document reading operation will be described. When the CISSTART signal 902 becomes active, the CIS sensor unit 901 starts accumulating charges based on the light emitted from the light emitting element 907 and reflected by the document sheet G, and sequentially sets charge data accumulated in an output buffer 904. The timing generator 917 outputs to the shift register 905, for example, the CISCLK signal 915 having a clock frequency of about 500 kHz to 1 MHz. The shift register 905 outputs the charge data set in the output buffer 904 to the A/D converter 908 as the CISSNS signal 918 in synchronization with the input CISCLK signal 915. Since the CISSNS signal 918 includes a predetermined data guaranteed region, the A/D converter 908 needs to perform sampling of the CISSNS signal 918 when a predetermined time has elapsed since the rising timing of the CISCLK signal 915 (transfer clock). The CISSNS signal 918 is output from the shift register 905 in synchronization with both the rising and falling edges of the CISCLK signal 915 (transfer clock). Therefore, the timing generator 917 generates the ADCLK signal 916 and the CISCLK signal 915 so that the frequency of the ADCLK signal 916 (a clock for sampling the CISSNS signal 918) become twice the frequency of the CISCLK signal 915. Then, the CISSNS signal 918 is sampled on the rising edge of the ADCLK signal 916. The timing generator 917 divides the SYSCLK signal 914 (input system clock) to generate the ADCLK signal 916 and the CISCLK signal 915 (transfer clock). The phase of the ADCLK signal 916 lags behind the CISCLK signal 915 (transfer clock) by the amount of the above-described data guaranteed region.

The A/D converter 908 converts the CISSNS signal 918 to a digital signal, and outputs the digital signal to an output interface circuit 909 as a CISSNS_D signal 919. The output interface circuit 909 outputs the CISSNS_D signal 919 at a predetermined timing as the SI_out signal 910 (serial data). In this case, an analog output reference voltage is output to the CISSNS_D signal 919 for a predetermined number of pixels from the CISSTART signal 902 (start pulse). These pixels cannot be used as effective pixels.

Via the ASIC 802, the control circuit 911 controls the A/D conversion gain of the A/D converter 908 based on the SI_in signal 912 and the SI_select signal 913 from the CPU 801. For example, if enough contrast of the read document image cannot be acquired, the CPU 801 increases the A/D conversion gain of the A/D converter 908 to increase the contrast so that the document can be read constantly with the best contrast.

Although the image forming apparatus 1 is configured to output image information of all pixels as the CISSNS_D signal 919 (output signal), the configuration is not limited thereto. The image forming apparatus 1 may be configured to divide pixels into a plurality of areas and simultaneously apply A/D conversion to the plurality of areas to achieve high-speed document reading. Although a CIS sensor is used for the document reading unit 100 herein, the CIS sensor may be replaced with a complementary metal-oxide semiconductor (CMOS) sensor or a charge-coupled device (CCD) sensor.

<Document Conveyance Timing>

Next, conveyance timing control for document sheets G when performing two-sided reading of image information of a plurality of document sheets G and continuous two-sided printing of the read image information on a plurality of recording materials S, according to the present exemplary embodiment, will be described. When a plurality of recording materials S or document sheets G exists, the following designation rule is applied in descriptions to distinguish each of the plurality of recording materials S or document sheets G. That is, the plurality of recording materials S stored in the first sheet feed unit 30 is referred to as S1, S2, S3, and so on in order of conveyance at the time of image formation. Likewise, the plurality of document sheets G stored in the second sheet feed unit 90 is referred to as G1, G2, G3, and so on in order of conveyance at the time of document reading. When it is not necessary to describe a plurality of sheets distinctly, one sheet is referred to as a recording material S or a document sheet G in descriptions.

Figure 4B:
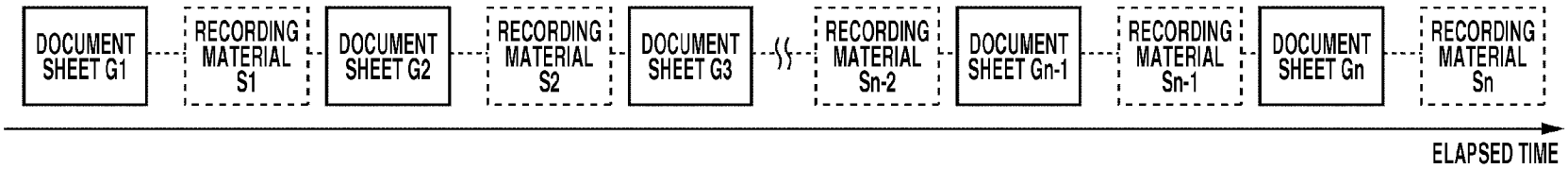
FIG. 4B illustrates the order of conveyance of document sheets and recording materials to a common conveyance path.

A conveyance path ranging from the discharge roller pair 60 to the conveyance roller pair 41 is defined as a recording material conveyance path 83. A conveyance path ranging from the document pickup roller 91 to the conveyance roller pair 41 is defined as a document conveyance path 84. A conveyance path ranging from the conveyance roller pair 41 to the conveyance roller pair 42 is defined as a common conveyance path 85. These definitions will be used in the following descriptions. FIG. 4B illustrates the order of conveyance of the document sheets G and the recording materials S in the common conveyance path 85 according to the present exemplary embodiment. In a case of a process of two-sided reading of n document sheets and two-sided printing on n recording materials, the document sheets G and the recording materials S are alternately conveyed in the common conveyance path 85 in order of the document sheet G1, the recording material S1, the document sheet G2, the recording material S2, the document sheet G3, . . . , the recording material Sn−1, the document sheet Gn, and the recording material Sn. While alternately conveying the document sheets G and the recording materials S in this order, the CPU 801 continuously performs reading of the document sheets G and image formation on the recording materials S. The present exemplary embodiment is characterized in controlling the time when the document sheet G starts to be conveyed in the document conveyance path 84 to achieve conveyance control for alternately conveying the document sheet G and the recording material S in the common conveyance path 85.

Operations performed according to the present exemplary embodiment will be described below particularly focusing on conveyance order control for the recording material S1 and the document sheet G2 out of conveyance order control for the document sheets G and the recording materials S. Therefore, in the following descriptions, subsequent operations will be described in detail below on the premise that two-sided reading of the document sheet G1 is completed, the second side (back side) of the document sheet G1 has been printed on the recording material S1, and the recording material S1 is currently being conveyed toward the common conveyance path 85.

Figure 5A:
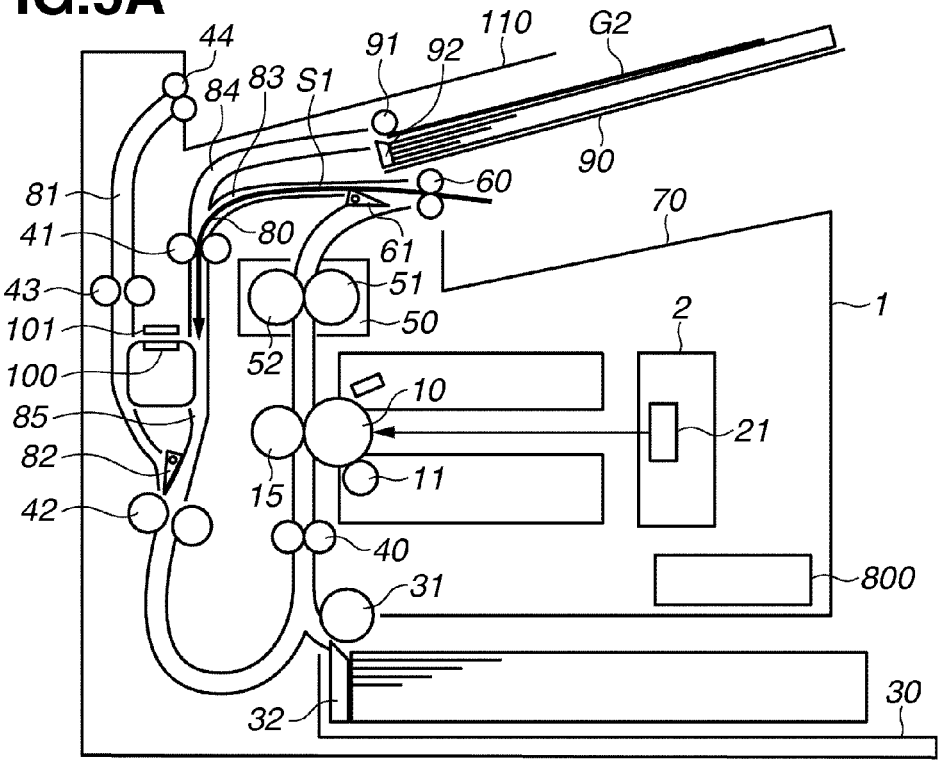
FIG. 5A illustrates a state where a document sheet is ready for conveyance.

FIG. 5A illustrates a state where the document sheet G2 is ready for conveyance. Referring to FIG. 5A, the document sheet G2 is drawn with a bold solid line without an arrow head at both ends. Hereinafter, such a bold solid line indicates that the document sheet G2 is stopped. The recording material S1 is once suspended at the first discharge unit 70, and then starts to be conveyed by the discharge roller pair 60 from the position of the discharge roller pair 60 (reversing start position). Then, the recording material S1 is conveyed in the recording material conveyance path 83 by the discharge roller pair 60, and then enters the common conveyance path 85. The document sheet G2 is stored in the second sheet feed unit 90, and waits till the time when the document sheet G2 starts to be conveyed in the document conveyance path 84, calculated by the CPU 801 (described below). The time when the document sheet G2 starts to be conveyed in the document conveyance path 84 refers to time with reference to a printing start time of the image forming apparatus 1. The time when the document sheet G2 starts to be conveyed also refers to the time when, during conveyance of the document sheet G2 through the document conveyance path 84 to the common conveyance path 85, it becomes possible for the document sheet G2 to be conveyed by following the trailing edge of the recording material S1 while avoiding collision between the recording material S1 and the document sheet G2 in the common conveyance path 85.

Figure 5B:
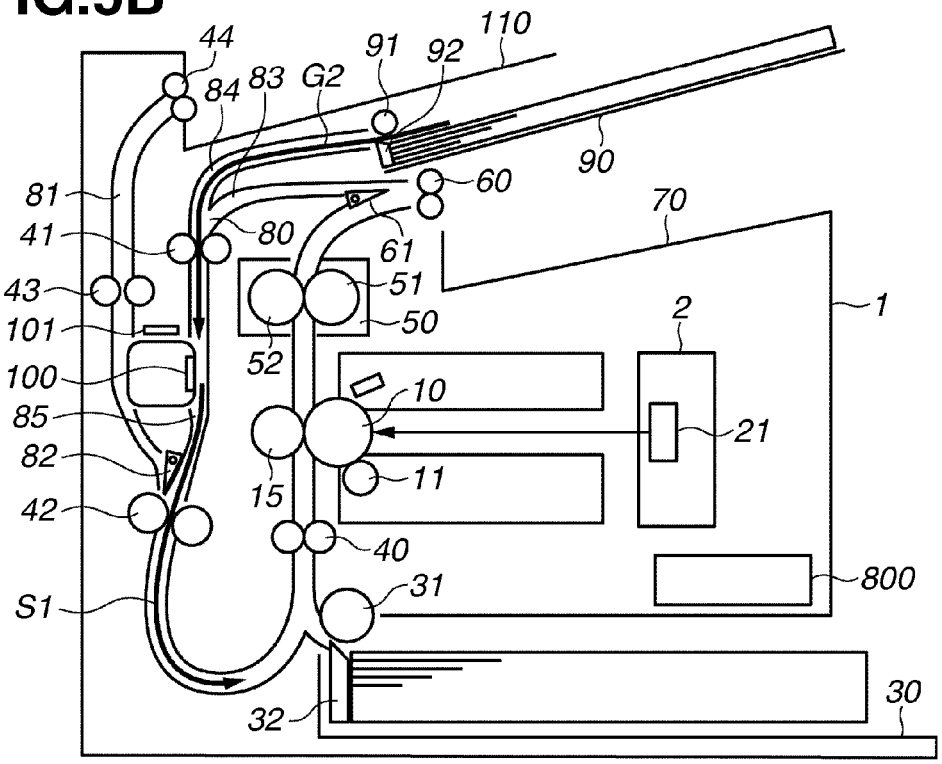
FIG. 5B illustrates an operation of the document sheet to enter a two-sided conveyance path according to the first exemplary embodiment.

FIG. 5B illustrates an operation of the document sheet G2 to enter the common conveyance path 85. When the elapsed time from the reference time reaches the time when the document sheet G2 starts to be conveyed in the document conveyance path 84, the document sheet G2 starts to be conveyed from the second sheet feed unit 90 through the document conveyance path 84 toward the common conveyance path 85 by the document pickup roller 91 and the separation member 92. When the document sheet G2 enters the common conveyance path 85, the document sheet G2 is pinched by the conveyance roller pair 41. When the leading edge of the document sheet G2 is pinched by the conveyance roller pair 41, the trailing edge of the recording material S1 has already passed the conveyance roller pair 41. Then, the document sheet G2 and the recording material S1 are conveyed in the common conveyance path 85 with a sufficient conveyance interval therebetween so that the document sheet G2 and the recording material S1 do not collide with each other. In the meantime, by the time when the document sheet G2 enters the common conveyance path 85 and reading of the first side (front side) of the document sheet G2 is started, the document reading unit 100 completes preparation for document reading to prepare for reading the document sheet G2. Preparation for document reading refers to operations for securing an image storage area in the image memory 804 and rotating the image reading unit 100 to face the common conveyance path 85. While the document sheet G2 is passing the document reading unit 100, the document reading unit 100 reads image information of the first side (front side) of the document sheet G2, and stores the read image information in the image memory 804.

The recording material S1 is conveyed in the recording material conveyance path 83 at a conveyance speed Vp1, and conveyed in the common conveyance path 85 at a conveyance speed Vp2. The document sheet G2 is conveyed in the document conveyance path 84 at a conveyance speed Vs1, and conveyed in the common conveyance path 85 at a conveyance speed Vs2. In the present exemplary embodiment, the conveyance speed Vp1 is determined by an optimum conveyance speed for image formation, and the conveyance speeds Vs1 and Vs2 are determined by an optimum conveyance speed for document reading. The conveyance speeds Vp1, Vs1, and Vs2 do not change during printing operation. After the document sheet G2 and the recording material S1 enter the common conveyance path 85, the CPU 801 controls the conveyance speed Vp2 of the recording material S1 (Vp2=Vs2) so that the document sheet G2 and the recording material S1 are conveyed while maintaining constant distance between the leading edge of the document sheet G2 and the trailing edge of the recording material S1.

In the present exemplary embodiment, to avoid collision between the recording material S1 and the document sheet G2 in the common conveyance path 85, the CPU 801 controls only the time when the document sheet G2 starts to be conveyed in the document conveyance path 84, and does not control the conveyance speed Vs1 of the document sheet G2 in the document conveyance path 84. Specifically, the CPU 801 controls only the timing for starting conveyance of the document sheet G2 from the second sheet feed unit 90. Subsequently, the CPU 801 reads the second side (back side) of the document sheet G2, prints the first side (front side) of the document sheet G1 on the recording material S1, and prints the second side (back side) of the document sheet G2 on the recording material S2. However, subsequent operations are performed in the above-described process illustrated in FIGS. 2C and 2E, and detailed descriptions thereof will be omitted. This completes descriptions of conveyance timing control for conveying the document sheet G in the common conveyance path 85 when performing two-sided reading of image information of a plurality of document sheets G and continuous two-sided printing of the read image information on a plurality of recording materials S.

<Descriptions of Recording Material and Document Conveyance Operations>

Figure 6:
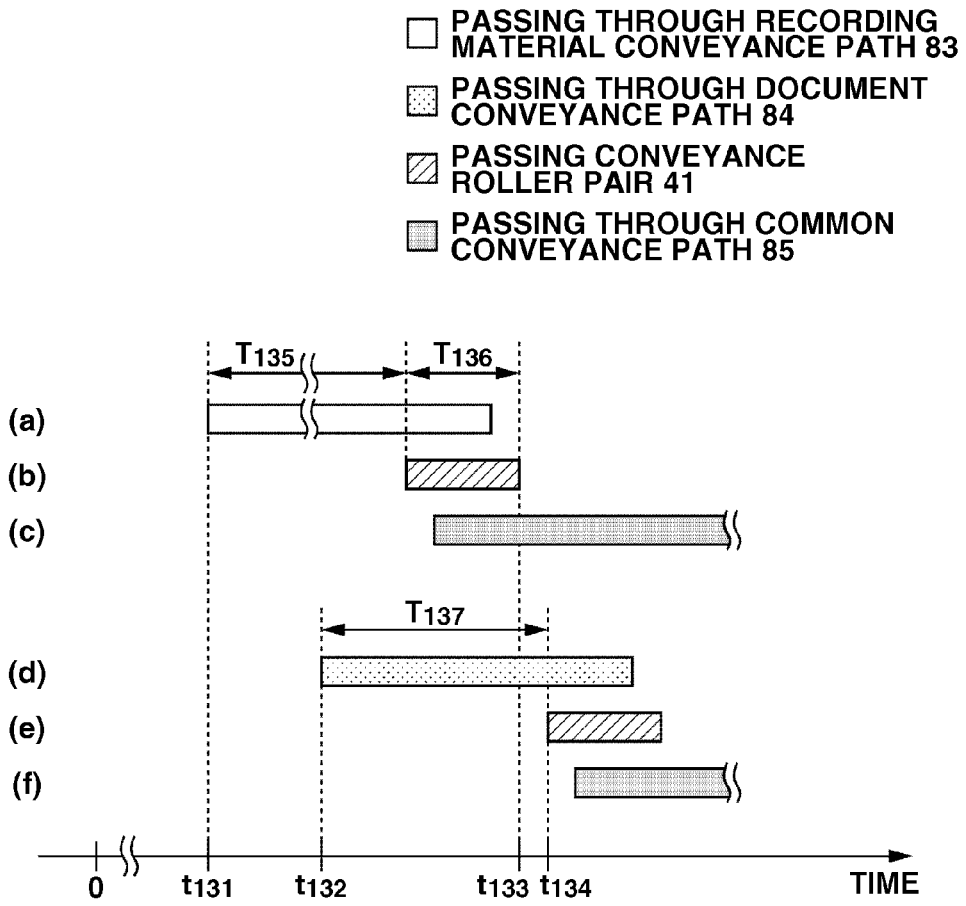
FIG. 6 is a timing chart illustrating recording material and document conveyance operations according to the first exemplary embodiment.

FIG. 6 is a timing chart illustrating conveyance operations for the recording material S1 and the document sheet G2. Referring to FIG. 6, timing (a) indicates that the recording material S1 is passing through the recording material conveyance path 83, timing (b) indicates that the recording material S1 is passing the conveyance roller pair 41, timing (c) indicates that the recording material S1 is passing through the common conveyance path 85, timing (d) indicates that the document sheet G2 is passing through the document conveyance path 84, timing (e) indicates that the document sheet G2 is passing the conveyance roller pair 41, and timing (f) indicates that the document sheet G2 is passing through the common conveyance path 85. With the printing start time defined as a reference time 0, $t_{131}$ is defined as the time when the recording material S1 starts to be conveyed in the recording material conveyance path 83, and $t_{132}$ is defined as the time when the document sheet G2 starts to be conveyed in the document conveyance path 84. Further, with the printing start time defined as a reference time, $t_{133}$ is defined as the time when the recording material S1 has passed the conveyance roller pair 41, and $t_{134}$ is defined as the time when the document sheet G2 starts passing the conveyance roller pair 41. $T_{135}$ is defined as a required time since the time when the recording material S1 starts to be conveyed in the recording material conveyance path 83 till the time when the recording material S1 starts passing the conveyance roller pair 41. $T_{136}$ is defined as a required time since the time when the recording material S1 starts passing the conveyance roller pair 41 till the time when the recording material S1 has passed the conveyance roller pair 41. $T_{137}$ is defined as a required time since the time when the document sheet G2 starts to be conveyed in the document conveyance path 84 till the time when the document sheet G2 starts passing the conveyance roller pair 41.

The time when the document sheet G or the recording material S starts passing the conveyance roller pair 41 refers to the time when the leading edge of the document sheet G or the recording material S reaches the conveyance roller pair 41. The time when the document sheet G or the recording material S has passed the conveyance roller pair 41 refers to the time when the trailing edge of the document sheet G or the recording material S leaves the conveyance roller pair 41. According to the configuration of the present exemplary embodiment, the CPU 801 controls the time $t_{132}$ when the document sheet G2 starts to be conveyed in the document conveyance path 84 to control the order of the recording material S1 and the document sheet G2 passing through the common conveyance path 85. Since the CPU 801 performs control to convey the recording material S1 in the common conveyance path 85 earlier than the document sheet G2, the time $t_{133}$ when the recording material S1 has passed the conveyance roller pair 41 precedes the time $t_{134}$ when the document sheet G starts passing the conveyance roller pair 41, as illustrated in FIG. 6. In other words, the trailing edge of the recording material S1 passes the conveyance roller pair 41 before the leading edge of the document sheet G2 reaches the conveyance roller pair 41, thus avoiding collision between the recording material S1 and the document sheet G2 in the common conveyance path 85. The CPU 801 calculates the required times $T_{135}$, $T_{136}$, and $T_{137}$, and the times $t_{132}$, $t_{133}$, and $t_{134}$ based on the time $t_{131}$ when the recording material S1 starts to be conveyed in the recording material conveyance path 83, the recording material conveyance speeds Vp1 and Vp2, and the document conveyance speeds Vs1 and Vs2 which are known information.

<Processing for Determining Start of Document Conveyance>

Figure 7:
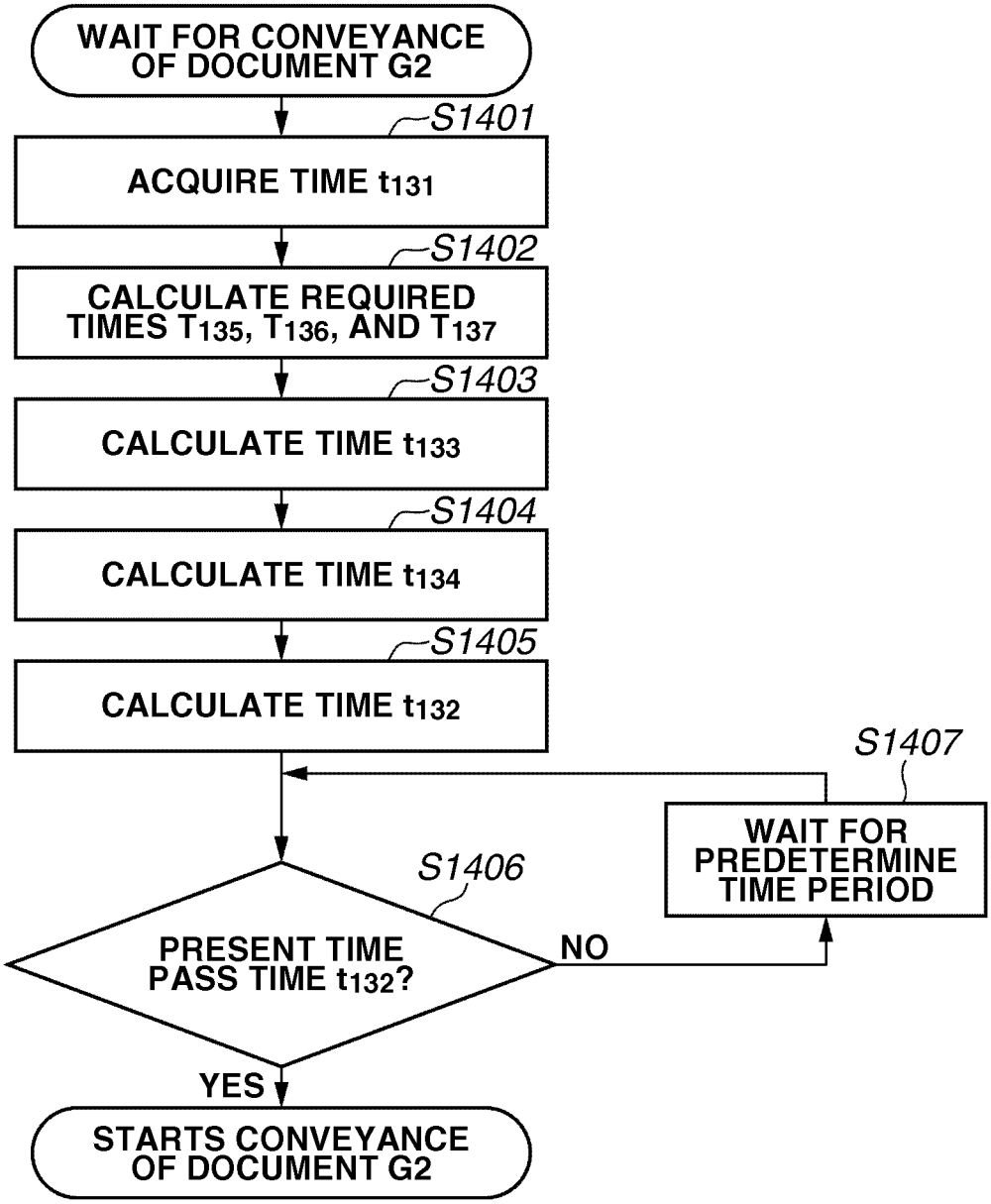
FIG. 7 is a flowchart illustrating an operation of a central processing unit (CPU) according to the first exemplary embodiment.

The processing by the CPU 801 for determining whether conveyance of the document sheet G2 is started will be described with reference to FIG. 7. The CPU 801 receives from the host computer (not illustrated) an instruction for two-sided reading of a plurality of document sheets G and two-sided printing on a plurality of recording materials S. In the process of reading control and printing control, the CPU 801 performs the processing illustrated in FIG. 7 ranging from the conveyance start standby state to the start of conveyance of the document sheet G. The processing for determining whether conveyance of the document sheet G2 is started will be described.

In step S1401, the CPU 801 acquires the time $t_{131}$ when the recording material S1 starts to be conveyed in the recording material conveyance path 83, which is known information. The CPU 801 acquires as the time $t_{131}$ information equivalent to the time $t_{131}$ when the recording material S1 starts to be conveyed in the recording material conveyance path 83, such as a reverse rotation start time of the discharge roller pair 60, stored in a random access memory (RAM) of the CPU 801. In step S1402, the CPU 801 calculates the required time $T_{135}$ from the time when the recording material S1 starts to be conveyed in the recording material conveyance path 83 to the time when the recording material S1 starts passing the conveyance roller pair 41, and the required time $T_{136}$ from the time when the recording material S1 starts passing the conveyance roller pair 41 to the time when the recording material S1 has passed the conveyance roller pair 41. The CPU 801 further calculates the required time $T_{137}$ from the time when the document sheet G2 starts to be conveyed in the document conveyance path 84 to the time when the document sheet G2 starts passing the conveyance roller pair 41.

The CPU 801 can calculate the required times $T_{135}$, $T_{136}$, and $T_{137}$ based on known information, such as the conveyance path length, the conveyance speeds Vp1 and Vp2 of the recording material S1, or the conveyance speed Vs1 of the document sheet G2. More specifically, the required time $T_{135}$ can be calculated based on the conveyance path length between the discharge roller pair 60 and the conveyance roller pair 41, and the conveyance speed Vp1 of the recording material S1. The required time $T_{136}$ can be calculated based on the length of the recording material S1 in the conveyance direction, and the conveyance speed Vp2 (=Vs2) of the recording material S1. The required time $T_{137}$ can be calculated based on the conveyance path length between the document pickup roller 91 and the conveyance roller pair 41, and the conveyance speed Vs1 of the document sheet G2. Further, the CPU 801 may refer to each required time in a table generated and stored in the program memory 803. This table indicates the correspondence between the conveyance speeds Vp1, Vp2, Vs1 and the required times $T_{135}$, $T_{136}$, and $T_{137}$.

In step S1403, the CPU 801 adds the required times $T_{135}$ and $T_{136}$ to the time $t_{131}$ to calculate the time $t_{133}$ when the recording material S1 has passed the conveyance roller pair 41 ($t_{133}=t_{131}+T_{135}+T_{136}$). As described above, it is necessary to control the time $t_{132}$ when the document sheet G2 starts to be conveyed in the document conveyance path 84 so that the time $t_{133}$ precedes the time $t_{134}$ when the document sheet G starts passing the conveyance roller pair 41. In step S1404, therefore, the CPU 801 calculates the time $t_{134}$ that satisfies $t_{133} \leq t_{134}$. The CPU 801 calculates the time $t_{134}$ to provide a certain fixed margin for the time difference between the times $t_{133}$ and $t_{134}$ in consideration of conveyance speed variation and mechanical accuracy. For example, this condition is given by $t_{134}=t_{133}+\Delta t$ where $\Delta t$ indicate the time difference to provide a certain fixed margin in consideration of conveyance speed variation and mechanical accuracy.

In step S1405, the CPU 801 subtracts the required time $T_{137}$ from the time $t_{134}$ (calculated in step S1404) to calculate the time $t_{132}$ when the document sheet G2 starts to be conveyed in the document conveyance path 84 ($t_{132}=t_{134}-T_{137}$). In step S1406, referring to a timer (not illustrated), the CPU 801 determines whether the present time has passed the time $t_{132}$. When the CPU 801 determines that the present time has not yet passed the time $t_{132}$ (NO in step S1406), the CPU 801 waits for a predetermined period of time in step S1407, and the processing returns to step S1406. On the other hand, when the CPU 801 determines that the present time has passed the time $t_{132}$ (YES in step S1406), the CPU 801 starts conveyance of the document sheet G2. This completes descriptions of the processing by the CPU 801 for determining whether conveyance of the document sheet G2 is to be started.

According to the configuration of the present exemplary embodiment, the CPU 801 stores information about the time $t_{131}$ when the recording material S1 starts to be conveyed in the recording material conveyance path 83 with reference to the printing start time, and uses the information to calculate the time $t_{132}$ when the document sheet G2 starts to be conveyed in the document conveyance path 84. However, it is also possible to provide a sensor in the middle of the conveyance path of the recording material S1, and calculate the time $t_{132}$ based on the time when the recording material S1 has passed the sensor. Further, the CPU 801 may calculate the time $t_{132}$ based on the time when the recording material S1 starts to be fed from the first sheet feed unit 30. In the present exemplary embodiment, the CPU 801 performs two-sided reading of the document sheet G in order of the first side (front side) of the document sheet G and the second side (back side) of the document sheet G. Further, the CPU 801 performs two-sided printing on the recording material S in order of the second side (back side) of the recording material S and the first side (front side) of the recording material S. However, the present invention is not limited the above-described order of reading and printing. The present invention is applicable even if the order of the two-sided reading of the document sheet G and the order of two-sided printing on the recording material S are changed.

Thus, according to the configuration of the present exemplary embodiment, conveyance timing control for conveying the document sheet G2 in the document conveyance path 84 can be performed. As a result, the conveyance order and the conveyance interval of the document sheet G and the recording material S can be accurately controlled. Thus, it is possible to achieve a process of two-sided reading of image information of a plurality of document sheets G and continuous two-sided printing of the read image information on a plurality of recording materials S with high productivity, without requiring a complicated apparatus configuration. As described above, according to the present exemplary embodiment, it is possible to prevent degradation of the productivity in a case where a document reading operation and a printing operation are performed in parallel based on a configuration in which a recording material and a document sheet share a common conveyance path.

In the first exemplary embodiment, the recording material S passes through the common conveyance path 85 earlier than the document sheet G, and the timing for conveying the document sheet G in the common conveyance path 85 is adjusted only with the relevant document conveyance start time. A second exemplary embodiment differs from the first exemplary embodiment in that the document sheet G passes through the common conveyance path 85 earlier than the recording material S, and the conveyance timing for the common conveyance path 85 is adjusted with both the relevant document conveyance speed and the relevant document conveyance start time. The overall configuration of the image forming apparatus 1 is similar to that in the first exemplary embodiment, and detailed descriptions thereof will be omitted. However, the present exemplary embodiment differs from the first exemplary embodiment in that the image forming apparatus 1 includes a control unit 1500 instead of the control unit 800.

<Overview of Control Unit of Image Forming Apparatus>

Figure 8A:
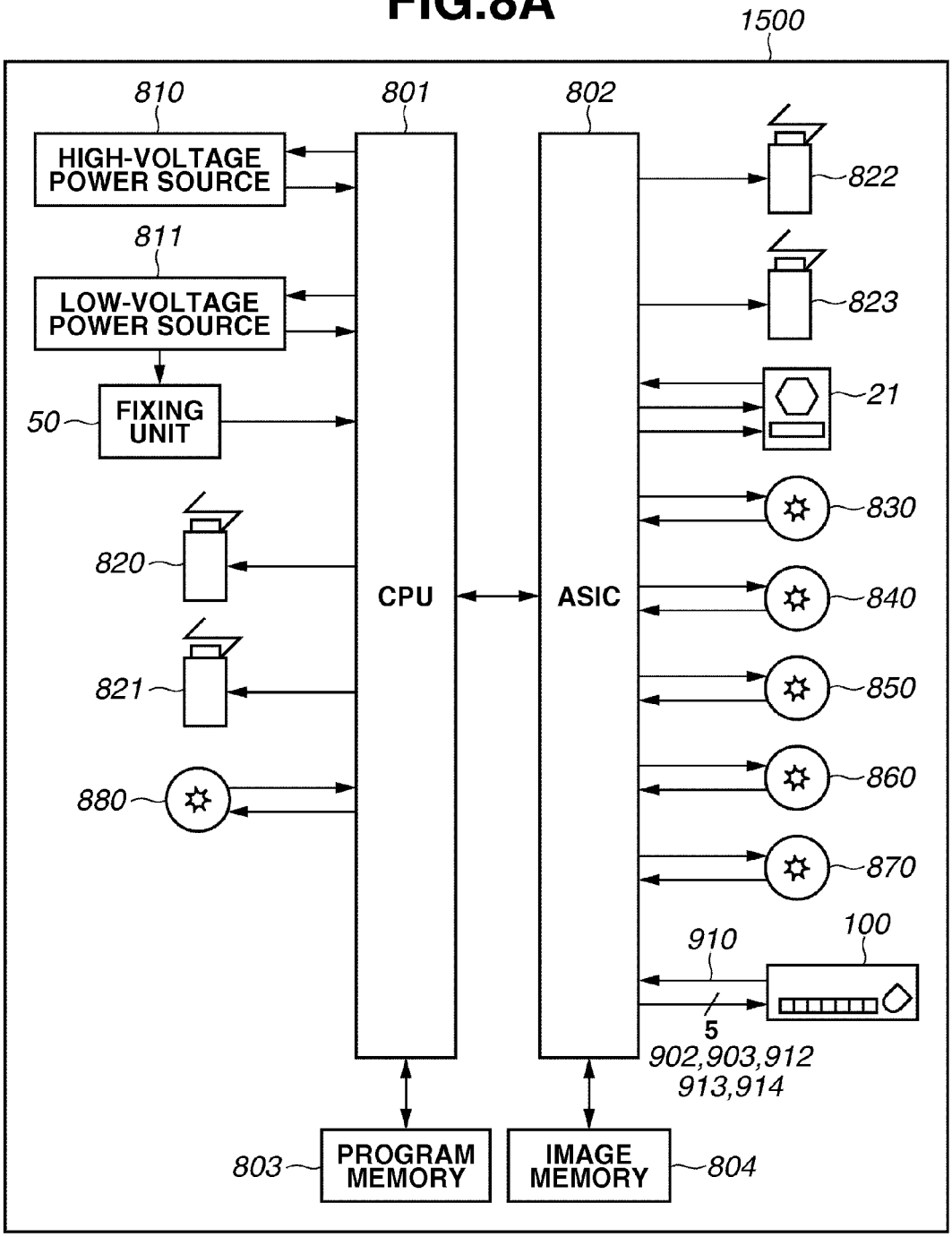
FIG. 8A is a block diagram illustrating a configuration of a control unit.

The control unit 1500 will be described below. FIG. 8A illustrates the control unit 1500 centering on the CPU 801 of the image forming apparatus 1 according to the present exemplary embodiment. The present exemplary embodiment differs from the first exemplary embodiment in the use of the document inversion driving motor 860, the document feeding drive motor 870, and the document dedicated conveyance path drive motor 880 controlled by the ASIC 802. Rollers driven by each motor will be described below. The two-sided drive motor 840 that drives the document pickup roller 91 and the conveyance roller pairs 41 to 44 in the first exemplary embodiment drives only the conveyance roller pair 41 in the present exemplary embodiment. The document inversion driving motor 860 drives the conveyance roller pair 42. The document feeding drive motor 870 drives the document pickup roller 91. The document dedicated conveyance path drive motor 880 drives the conveyance roller pairs 43 and 44. Similar to the first exemplary embodiment, the discharge roller drive motor 850 drives the discharge roller pair 60. Components having the same function as the control unit 800 are assigned the same reference numeral, and redundant descriptions thereof will be omitted.

<Document Conveyance Timing>

A conveyance timing control method for conveying the document sheet G in the common conveyance path 85 when performing two-sided reading of image information of a plurality of document sheets G and continuous two-sided printing of the read image information on a plurality of recording materials S, according to the prevent exemplary embodiment, will be described. Also in the present exemplary embodiment, when a plurality of recording materials S or document sheets G exists, a similar designation rule to that in the first exemplary embodiment is applied in descriptions to distinguish each of the plurality of recording materials S and document sheets G.

Figure 8B:
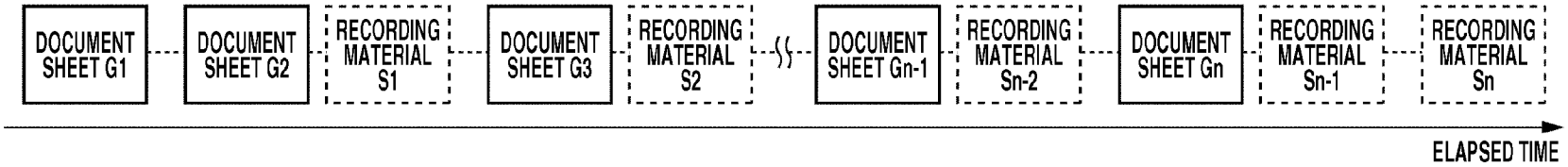
FIG. 8B illustrates the order of conveyance of document sheets and recording materials to a common conveyance path, according to a second exemplary embodiment of the present invention.

FIG. 8B illustrates the order of conveyance of the document sheets G and the recording materials S in the common conveyance path 85 according to the present exemplary embodiment. The document sheets G and the recording materials S are alternately conveyed in the common conveyance path 85 in order of the document sheet G1, the document sheet G2, the recording material S1, the document sheet G3, the recording material S2, . . . , the document sheet Gn−1, the recording material Sn−2, the document sheet Gn, the recording material Sn−1, and the recording material Sn. The CPU 801 continuously performs reading the document sheets G and image formation on the recording materials S while alternately conveying the document sheets G and the recording materials S in the above-described order. The present exemplary embodiment is characterized in controlling both the relevant conveyance start time and the relevant conveyance speed of the document sheet G to achieve conveyance control for alternately conveying the document sheet G and the recording material S in the common conveyance path 85.

Operations performed according to the present exemplary embodiment will be described below particularly focusing on conveyance order control for the recording material S1 and the document sheet G2 out of conveyance order control for the document sheets G and the recording materials S. Therefore, in the following descriptions, subsequent operations will be described in detail below on the premise that two-sided reading of the document sheet G1 is completed, the recording material S1 has started to be conveyed from the first sheet feed unit 30 to print the second side (back side) of the document sheet G1 on the recording material S1.

Figure 9A:
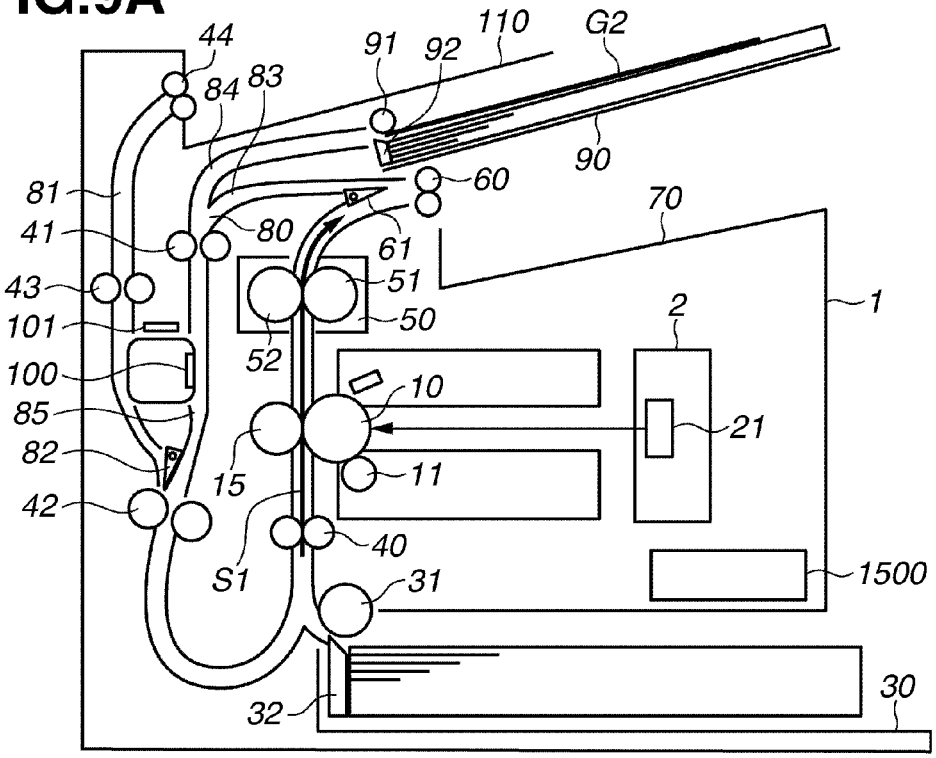
FIG. 9A illustrates a state where a document sheet is ready for conveyance.

FIG. 9A illustrates a state where the document sheet G2 is ready for conveyance. The recording material S1 passes the transfer unit 15 and the fixing unit 50, and the second side (back side) of the document sheet G1 is printed on one side of the recording material S1 in a known image formation process. The document sheet G2 is stored in the second sheet feed unit 90, and waits till the time when the document sheet G2 starts to be conveyed in the document conveyance path 84, calculated by the CPU 801 (described below). The time when the document sheet G2 starts to be conveyed in the document conveyance path 84 refers to time with reference to the printing start time of the image forming apparatus 1. The time when the document sheet G2 starts to be conveyed also refers to the time when, during conveyance of the document sheet G2 from the second sheet feed unit 90 to the common conveyance path 85, it becomes possible for the recording material S1 to be conveyed by following the trailing edge of the document sheet G2 while avoiding collision between the recording material S1 and the document sheet G2 in the common conveyance path 85.

Figure 9B:
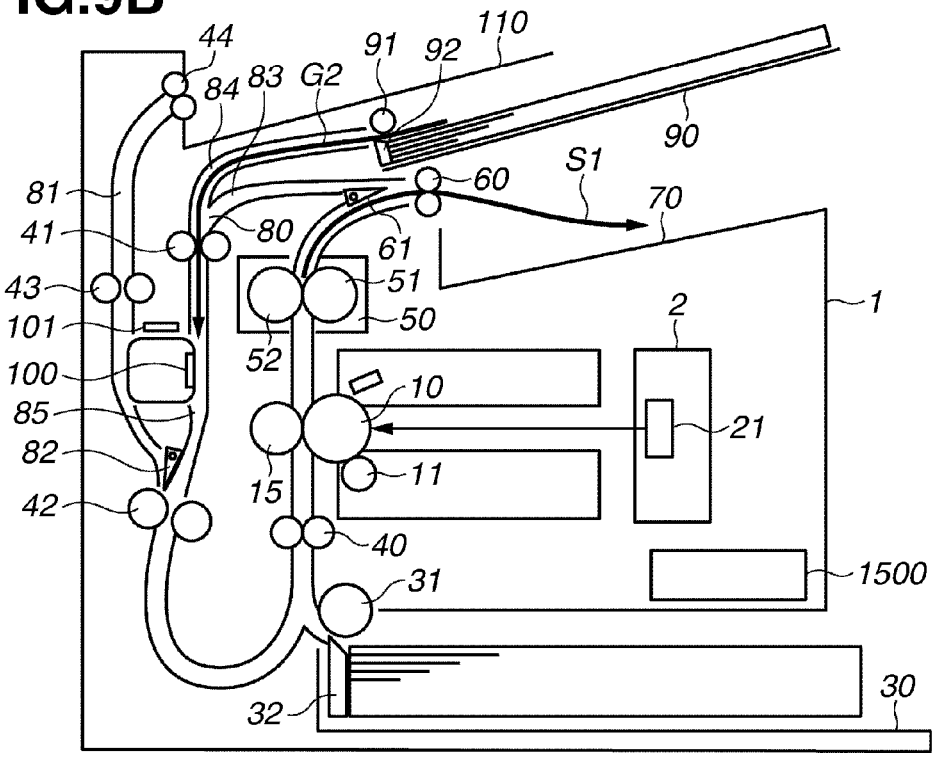
FIG. 9B illustrates an operation of the document sheet to enter the two-sided conveyance path according to the second exemplary embodiment.

FIG. 9B illustrates an operation of the document sheet G2 to enter the common conveyance path 85. When the elapsed time from the reference time reaches the time when the document sheet G2 starts to be conveyed from the second sheet feed unit 90 through the document conveyance path 84 toward the common conveyance path 85 by the document pickup roller 91 and the separation member 92. In this case, the document sheet G2 is conveyed in the document conveyance path 84 at the conveyance speed Vs1. The conveyance speed Vs1 is adjusted to a conveyance speed at which the recording material S1 can be conveyed by following the trailing edge of the document sheet G2 while avoiding collision between the recording material S1 and the document sheet G2 in the common conveyance path 85. When the document sheet G2 enters the common conveyance path 85, the document sheet G2 is pinched and conveyed by the conveyance roller pair 41. The recording material S1 is pinched by the discharge roller pair 60, and conveyed toward the first discharge unit 70. In the meantime, by the time when the document sheet G2 enters the common conveyance path 85 and reading of the first side (front side) of the document sheet G2 is started, the document reading unit 100 completes preparation for document reading to prepare for reading the document sheet G2.

Figure 9C:
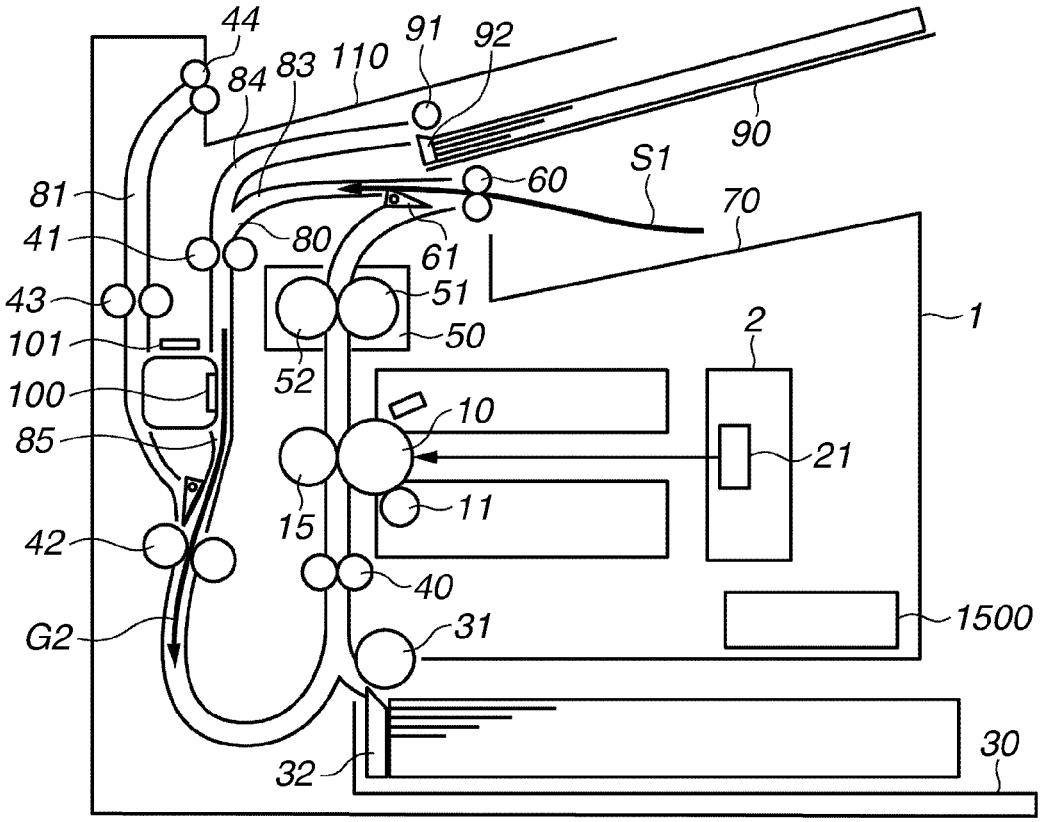
FIG. 9C illustrates a document sheet conveyance operation in the two-sided conveyance path according to the second exemplary embodiment.

FIG. 9C illustrates a conveyance operation for the document sheet G2 in the common conveyance path 85. The document sheet G2 moves in the common conveyance path 85. While the document sheet G2 is passing the document reading unit 100, the document reading unit 100 reads image information of the first side (front side) of the document sheet G2, and stores the read image information in the image memory 804. When the document sheet G is conveyed in the common conveyance path 85 at the conveyance speed Vs2, the conveyance speed Vs2 is adjusted to an optimum conveyance speed in consideration of the reading speed of the document reading unit 100. The recording material S1 is switchback while being pinched by the discharge roller pair 60, passes through the recording material conveyance path 83, and advances toward the common conveyance path 85. When the recording material S1 enters the common conveyance path 85 and the leading edge is pinched by the conveyance roller pair 41, the trailing edge of the document sheet G2 has already passed the conveyance roller pair 41. The CPU 801 controls the conveyance roller pair 41 and the conveyance roller pair 42 so that the document sheet G2 and the recording material S1 are conveyed in the common conveyance path 85 with a sufficient conveyance interval therebetween so that the document sheet G2 and the recording material S1 do not collide with each other.

The recording material S1 is conveyed in the recording material conveyance path 83 at the conveyance speed Vp1, and conveyed in the common conveyance path 85 at the conveyance speed Vp2. Similar to the first exemplary embodiment, the conveyance speed Vp1 is determined by the optimum conveyance speed for image formation, and the conveyance speed Vp2 is controlled to satisfy Vp2=Vs2. However, in the present exemplary embodiment, to avoid collision between the recording material S1 and the document sheet G2 in the common conveyance path 85, the CPU 801 controls both the time when the document sheet G2 starts to be conveyed in the document conveyance path 84, and the conveyance speed of the document sheet G2 in the document conveyance path 84. In other words, the CPU 801 controls the timing for starting conveyance of the document sheet G2 from the second sheet feed unit 90, and controls the conveyance speed Vs1 of the document sheet G2 during conveyance from the second sheet feed unit 90 to the common conveyance path 85.

Subsequently, the CPU 801 reads the second side (back side) of the document sheet G2, prints the first side (front side) of the document sheet G1 on the recording material S1, and prints the second side (back side) of the document sheet G2 on the recording material S2. However, subsequent operations are performed in the above-described process illustrated in FIGS. 2C and 2E, and detailed descriptions thereof will be omitted. This completes descriptions of conveyance control for conveying the document G in the common conveyance path 85 when performing two-sided reading of image information of a plurality of document sheets G and continuous two-sided printing of the read image information on a plurality of recording materials S.

<Descriptions of Recording Material and Document Conveyance Operations>

Figure 10:
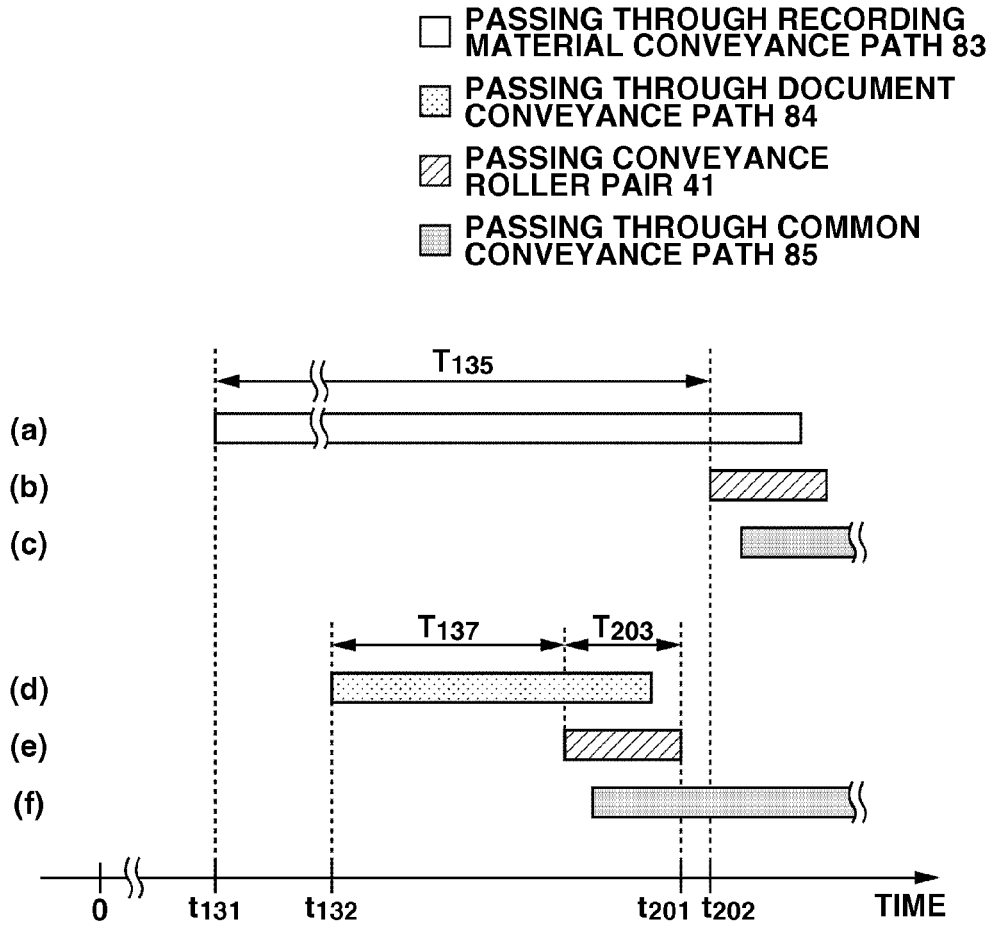
FIG. 10 is a timing chart illustrating recording material and document conveyance operations according to the second exemplary embodiment.

FIG. 10 is a timing chart illustrating conveyance operations for the recording material S1 and the document sheet G2. The timings (a) to (f) are similar to those in the first exemplary embodiment. The present exemplary embodiment differs from the first exemplary embodiment in that $t_{201}$ is defined as the time when the document sheet G2 has passed the conveyance roller pair 41, $t_{202}$ is defined as the time when the recording material S1 starts passing the conveyance roller pair 41, and $T_{203}$ is defined as the time required by the document sheet G2 to pass the conveyance roller pair 41. According to the configuration of the present exemplary embodiment, the time $t_{202}$ when the recording material S1 starts passing the conveyance roller pair 41 is later than the time $t_{201}$ when the document sheet G has passed the conveyance roller pair 41. The CPU 801 calculates the required times $T_{135}$, $T_{137}$, and $T_{203}$, and the times $t_{132}$, $t_{201}$, and $t_{202}$ based on the time $t_{131}$ when the recording material S1 starts to be conveyed in the recording material conveyance path 83, the recording material conveyance speeds Vp1 and Vp2, and the document conveyance speed Vs2, which are known information. Other processing is similar to that in the first exemplary embodiment, and detailed descriptions thereof will be omitted.

<Processing for Determining Start of Document Conveyance>

Figure 11:
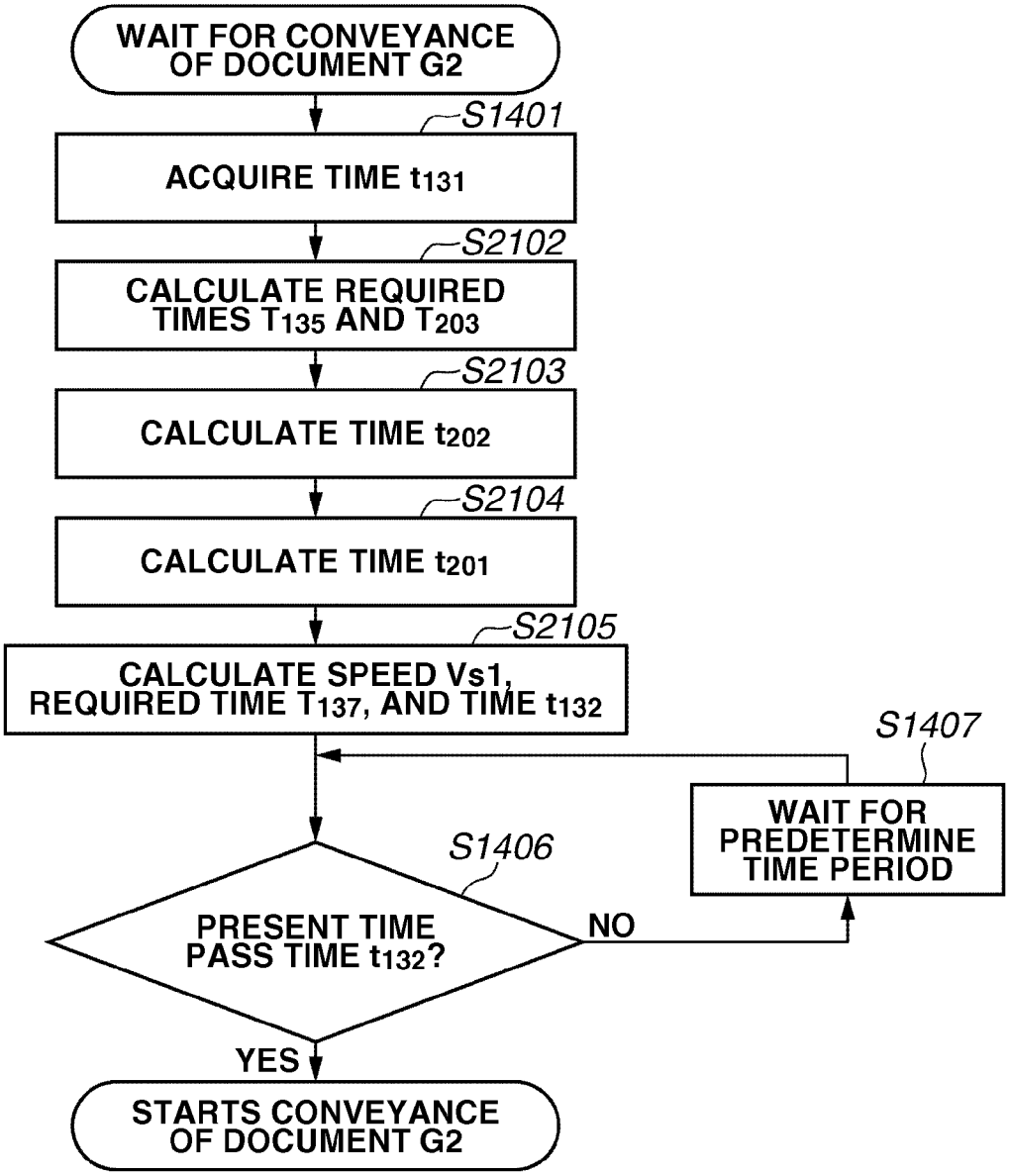
FIG. 11 is a flowchart illustrating an operation of the CPU according to the second exemplary embodiment.

The processing by the CPU 801 for determining whether conveyance of the document sheet G2 is started, will be described with reference to FIG. 11. Basic control is similar to that in the first exemplary embodiment. Steps having the same processing as those in the first exemplary embodiment illustrated in FIG. 7 are assigned the same step numbers, and redundant descriptions thereof will be omitted. The points different from the first exemplary embodiment will be described. In step S1401, by using a similar method to the one in the first exemplary embodiment, the CPU 801 acquires the time $t_{131}$ when the recording material S1 starts to be conveyed in the recording material conveyance path 83 which is known information. Then, the CPU 801 performs processing in step S2102 and subsequent steps. In step S2102, the CPU 801 calculates the required time $T_{135}$ from the time when the recording material S1 starts to be conveyed in the recording material conveyance path 83 to the time when the recording material S1 starts passing the conveyance roller pair 41, and the required time $T_{203}$ from the time when the document sheet G2 starts passing the conveyance roller pair 41 to the time when the document sheet G2 has passed the conveyance roller pair 41. When calculating the required time $T_{203}$, the CPU 801 uses the length of the document sheet G2 in the conveyance direction, and the previously acquired conveyance speed Vs2 (=Vp2) of the document sheet G2 in the common conveyance path 85.

In step S2103, the CPU 801 adds the required time $T_{135}$ to the time $t_{131}$ to calculate the time $t_{202}$ when the recording material S1 starts passing the conveyance roller pair 41 ($t_{202}=t_{131}+T_{135}$). As described above, it is necessary to control the time when the document sheet G2 starts to be conveyed so that the time $t_{202}$ is later than the time $t_{201}$ when the document sheet G has passed the conveyance roller pair 41. In step S2104, therefore, the CPU 801 calculates the time $t_{201}$ that satisfies $t_{201} \leq t_{202}$. In step S2105, the CPU 801 calculates the conveyance speed Vs1, the required time $T_{137}$, and the time $t_{132}$ when the document sheet G2 starts to be conveyed in the document conveyance path 84. In the present exemplary embodiment, it is necessary to perform control so that the time $t_{132}$ is later than the time $t_{131}$ ($t_{131} \leq t_{132}$). In step S2105, the CPU 801 calculates the conveyance speed Vs1 adjusted so that the time $t_{132}$ is later than the time $t_{131}$, and then calculates the required time $T_{137}$ based on the calculated conveyance speed Vs1 and the conveyance path length between the document pickup roller 91 and the conveyance roller pair 41. Then, the CPU 801 subtracts from the time $t_{201}$ the required time $T_{137}$ and the required time $T_{203}$ (calculated in step S2102) to calculate the time $t_{132}$ ($t_{132}=t_{201}-T_{203}-T_{137}$). Subsequent processing is similar to that in the first exemplary embodiment, and redundant descriptions thereof will be omitted. This completes descriptions of the processing by the CPU 801 for determining whether conveyance of the document sheet G2 is to be started.

According to the configuration of the present exemplary embodiment, conveyance timing control and conveyance speed control for conveying the document sheet G in the document conveyance path 84 can be performed. As a result, the conveyance order and the conveyance interval of the document sheet G and the recording material S can be accurately controlled. Further, in the present exemplary embodiment, the CPU 801 adjust both the time $t_{132}$ when the document sheet G starts to be conveyed in the document conveyance path 84, and the conveyance speed Vs1 in the document conveyance path 84. Thus, it is possible to achieve a process of two-sided reading of image information of a plurality of document sheets G and continuous two-sided printing of the read image information on a plurality of recording materials S with higher productivity than in the first exemplary embodiment, without requiring a complicated apparatus configuration. As described above, according to the present exemplary embodiment, it is possible to prevent degradation of the productivity in a case where a document reading operation and a printing operation are performed in parallel based on a configuration in which a recording material and a document sheet share a common conveyance path.

In the first and second exemplary embodiments, the CPU 801 controls the timing for conveying the document sheet G in the common conveyance path 85 in synchronization with the conveyance operation for the recording material S. The third exemplary embodiment differs from the first and second exemplary embodiments in that the CPU 801 controls the time when the recording material S passes through the common conveyance path 85 in synchronization with the conveyance operation for the document sheet G. The overall configuration and the control unit 1500 of the image forming apparatus 1 are similar to those in the above-described first and second exemplary embodiments, and detailed descriptions thereof will be omitted.

<Controlling Time when Recording Material Passes Through Common Conveyance Path>

A conveyance timing control method for conveying the document sheet G in the common conveyance path 85 when performing two-sided reading of image information of a plurality of document sheets G and continuous two-sided printing of the read image information on a plurality of recording materials S according to the exemplary embodiment, will be described. Also in the present exemplary embodiment, when a plurality of recording materials S or document sheets G exists, a similar designation rule to that in the first exemplary embodiment is applied in descriptions to distinguish each of the plurality of recording materials S or document sheets G.

The order of conveyance of the document sheets G and the recording materials S in the common conveyance path 85 according to the present exemplary embodiment is similar to the order of conveyance illustrated in FIG. 8B. In the present exemplary embodiment, the CPU 801 continuously performs reading of the document sheets G and image formation on the recording materials S while alternately conveying the document sheets G and the recording materials S in order of the document sheet G1, the document sheet G2, the recording material S1, the document sheet G3, the recording material S2, and so on. The present exemplary embodiment is characterized in controlling the time when the recording material S starts to be conveyed to achieve this conveyance control.

Operations performed by the present exemplary embodiment will be described below particularly focusing on conveyance order control for the recording material S1 and the document sheet G2 out of conveyance order control for the document sheets G and the recording materials S. Therefore, in the following descriptions, subsequent operations will be described in detail below on the premise that two-sided reading of the document sheet G1 is completed, and the second side (back side) of the document sheet G1 has been printed on the recording material S1.

Figure 12A:
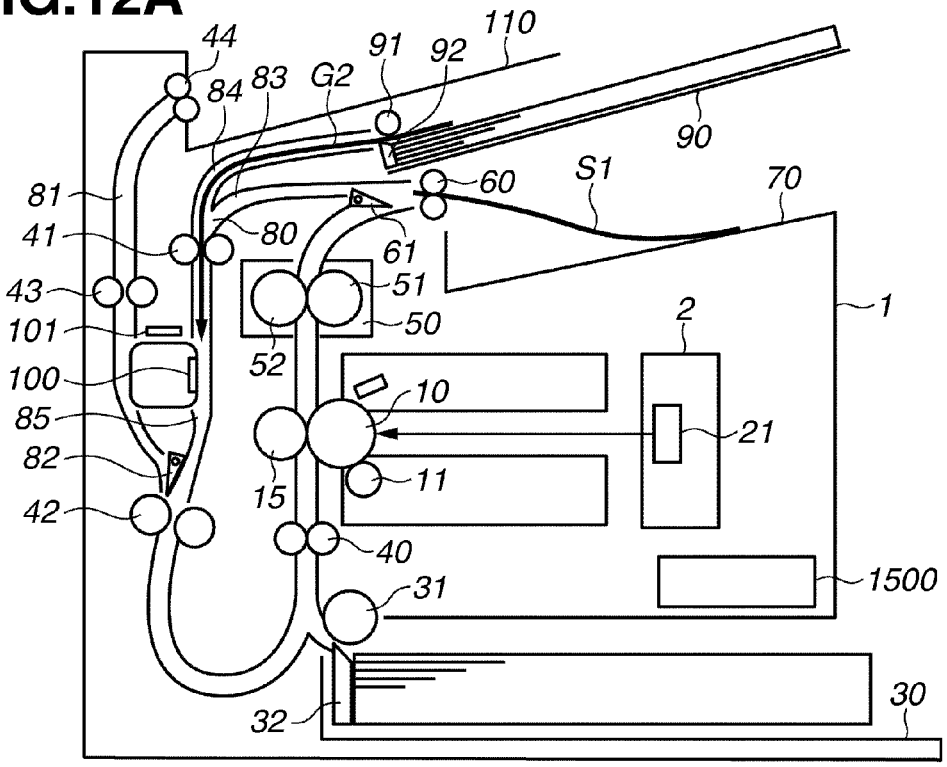
FIG. 12A illustrates a state where a recording material is ready for conveyance.

FIG. 12A illustrates a state where the recording material S1 is ready for conveyance. Referring to FIG. 12A, the recording material S1 is drawn with a bold solid line without an arrow head at both ends. Hereinafter, such a bold solid line indicates that the recording material S1 is stopped. After printing is made on the second side (back side), the recording material S1 is conveyed toward the first discharge unit 70, and then suspended while being pinched by the discharge roller pair 60. Then, the recording material S1 waits till the time when the recording material S1 starts to be conveyed in the recording material conveyance path 83 calculated by the CPU 801 (described below). The time when the recording material S1 starts to be conveyed in the recording material conveyance path 83 refers to time with reference to the printing start time of the image forming apparatus 1. The time when the recording material S1 starts to be conveyed in the recording material conveyance path 83 also refers to the time when, during conveyance of the recording material S1 from the discharge roller pair 60 through the recording material conveyance path 83 toward the common conveyance path 85, collision between the recording material S1 and the document sheet G2 in the common conveyance path 85 can be avoided. The time when the recording material S1 starts to be conveyed in recording material conveyance path 83 also refers to the time when it becomes possible for the recording material S1 to be conveyed by following the trailing edge of the document sheet G2. The document sheet G2 starts to be conveyed from the second sheet feed unit 90 to the document conveyance path 84 so that the document reading unit 100 reads image information. When the document sheet G2 enters the common conveyance path 85 from the document conveyance path 84, the document sheet G2 is pinched and conveyed by the conveyance roller pair 41. On the other hand, by the time when the document sheet G2 enters the common conveyance path 85 and reading of the first side (front side) of the document sheet G2 is started, the document reading unit 100 completes preparation for document reading to prepare for reading the document sheet G2.

Figure 12B:
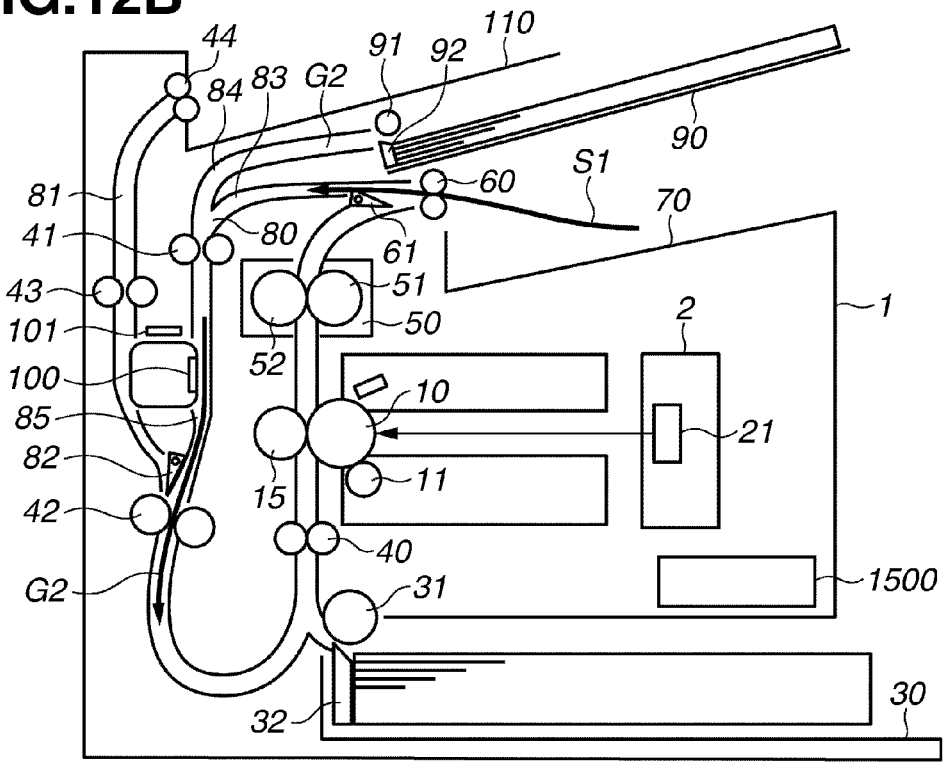
FIG. 12B illustrates a recording material conveyance operation, according to a third exemplary embodiment of the present invention.

FIG. 12B illustrates a conveyance operation for the recording material S1. When the time when the recoding material S1 starts to be conveyed in the recording material conveyance path 83 comes, the recoding material S1 is pinched and conveyed by the discharge roller pair 60, and advances toward the recording material conveyance path 83 and the common conveyance path 85. The document sheet G2 moves in the common conveyance path 85. While the document sheet G2 is passing the document reading unit 100, the document reading unit 100 reads image information of the first side (front side) of the document sheet G2, and stores the read image information in the image memory 804. When the recording material S1 enters the common conveyance path 85 and the leading edge of the recording material S1 is pinched by the conveyance roller pair 41, the trailing edge of the document sheet G2 has already passed the conveyance roller pair 41. Then, the document sheet G2 and the recording material S1 are conveyed in the common conveyance path 85 with a sufficient conveyance interval therebetween so that the document sheet G2 and the recording material S1 do not collide with each other.

The recording material S1 is conveyed in the recording material conveyance path 83 at the conveyance speed Vp1, and conveyed in the common conveyance path 85 at the conveyance speed Vp2. The document sheet G2 is conveyed in the document conveyance path 84 at the conveyance speed Vs1, and conveyed in the common conveyance path 85 at the conveyance speed Vs2. In the present exemplary embodiment, the conveyance speed Vp1 is determined by an optimum conveyance speed for image formation, and the conveyance speeds Vs1 and Vs2 are determined by the optimum conveyance speed for document reading. The conveyance speeds Vp1, Vs1, and Vs2 do not change during printing operation. After the document sheet G2 and the recording material S1 enter the common conveyance path 85, the CPU 801 controls the conveyance speed Vp2 of the recording material S1 (Vp2=Vs2) so that the document sheet G2 and the recording material S1 are conveyed while maintaining constant distance between the leading edge of the document sheet G2 and the trailing edge of the recording material S1.

In the present exemplary embodiment, to avoid collision between the recording material S1 and the document sheet G2 in the common conveyance path 85, the CPU 801 controls only the time when the recording material S1 starts to be conveyed in the recording material conveyance path 83, and does not control the conveyance speed of the recording material S1 in the recording material conveyance path 83. In other words, the CPU 801 controls only the timing for starting conveyance of the recording material S1 from the reversing start position. Subsequently, the CPU 801 reads the second side (back side) of the document sheet G2, prints the first side (front side) of the document sheet G1 on the recording material S1, and prints the second side (back side) of the document sheet G2 on the recording material S2. However, subsequent operations are performed in the above-described process illustrated in FIGS. 2C and 2E, and detailed descriptions thereof will be omitted. This completes descriptions of the conveyance timing control method for conveying the recording material S in the common conveyance path 85 when performing two-sided reading of image information of a plurality of document sheets G and continuous two-sided printing of the read image information on a plurality of recording materials S.

<Descriptions of Recording Material and Document Conveyance Operations>

Figure 13:
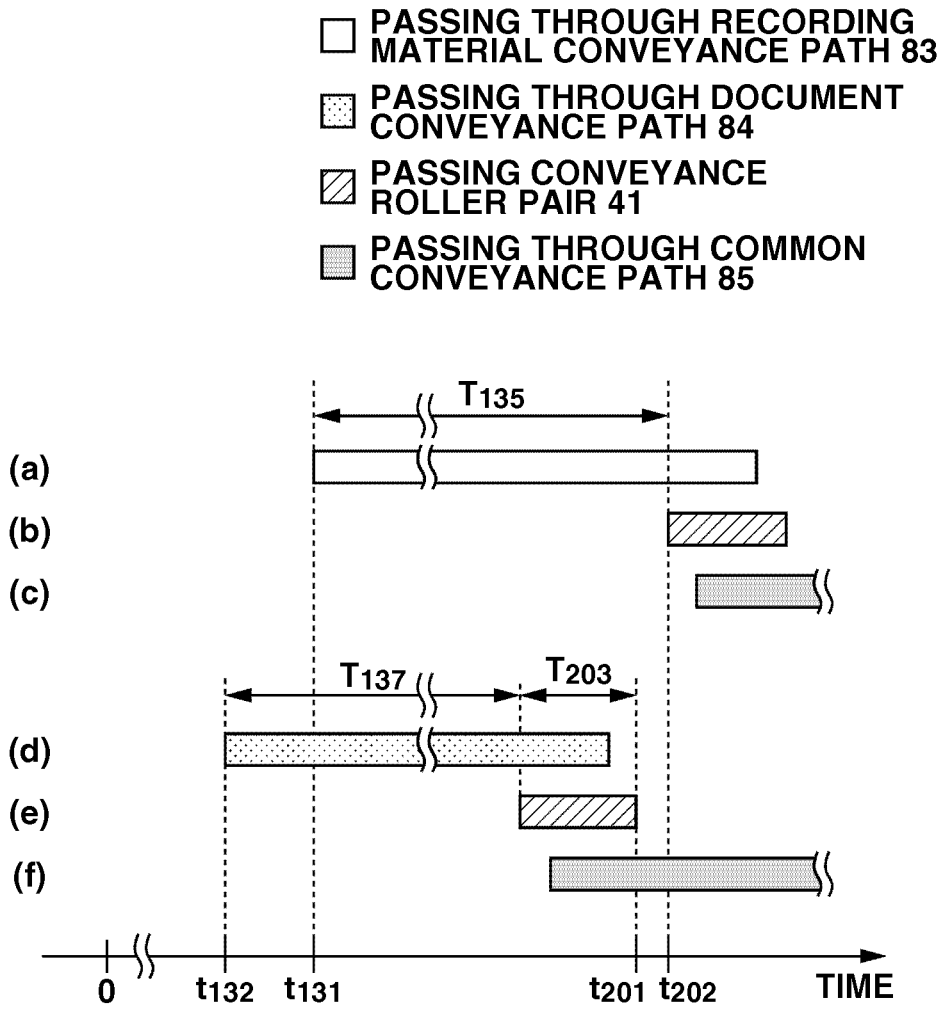
FIG. 13 is a timing chart illustrating recording material and document conveyance operations according to the third exemplary embodiment.

FIG. 13 is a timing chart illustrating conveyance operations for the recording material S1 and the document sheet G2. Components having the same function as those in the first and second exemplary embodiments are assigned the same reference numeral, and redundant descriptions thereof will be omitted. According to the configuration of the present exemplary embodiment, the CPU 801 controls the time $t_{131}$ when the recording material S1 starts to be conveyed in the recording material conveyance path 83 to control the order of the recording material S1 and the document sheet G2 passing through the common conveyance path 85. Since the CPU 801 performs control to convey the document sheet G2 in the common conveyance path 85 earlier than the recording material S1, the time $t_{202}$ when the recording material S1 starts passing the conveyance roller pair 41 is later than the time $t_{201}$ when the document sheet G2 has passed the conveyance roller pair 41, as illustrated in FIG. 13. The CPU 801 calculates the required times $T_{135}$, $T_{137}$, and $T_{203}$, and the times $t_{131}$, $t_{201}$, and $t_{202}$ based on the time $t_{132}$ when the document sheet G2 starts to be conveyed in the document conveyance path 84, the recording material conveyance speeds Vp1 and Vp2, and the document conveyance speeds Vs1 and Vs2, which are known information. Other processing is similar to that in the above-described exemplary embodiments, and detailed descriptions thereof will be omitted.

<Processing for Determining Start of Recording Material Conveyance>

Figure 14:
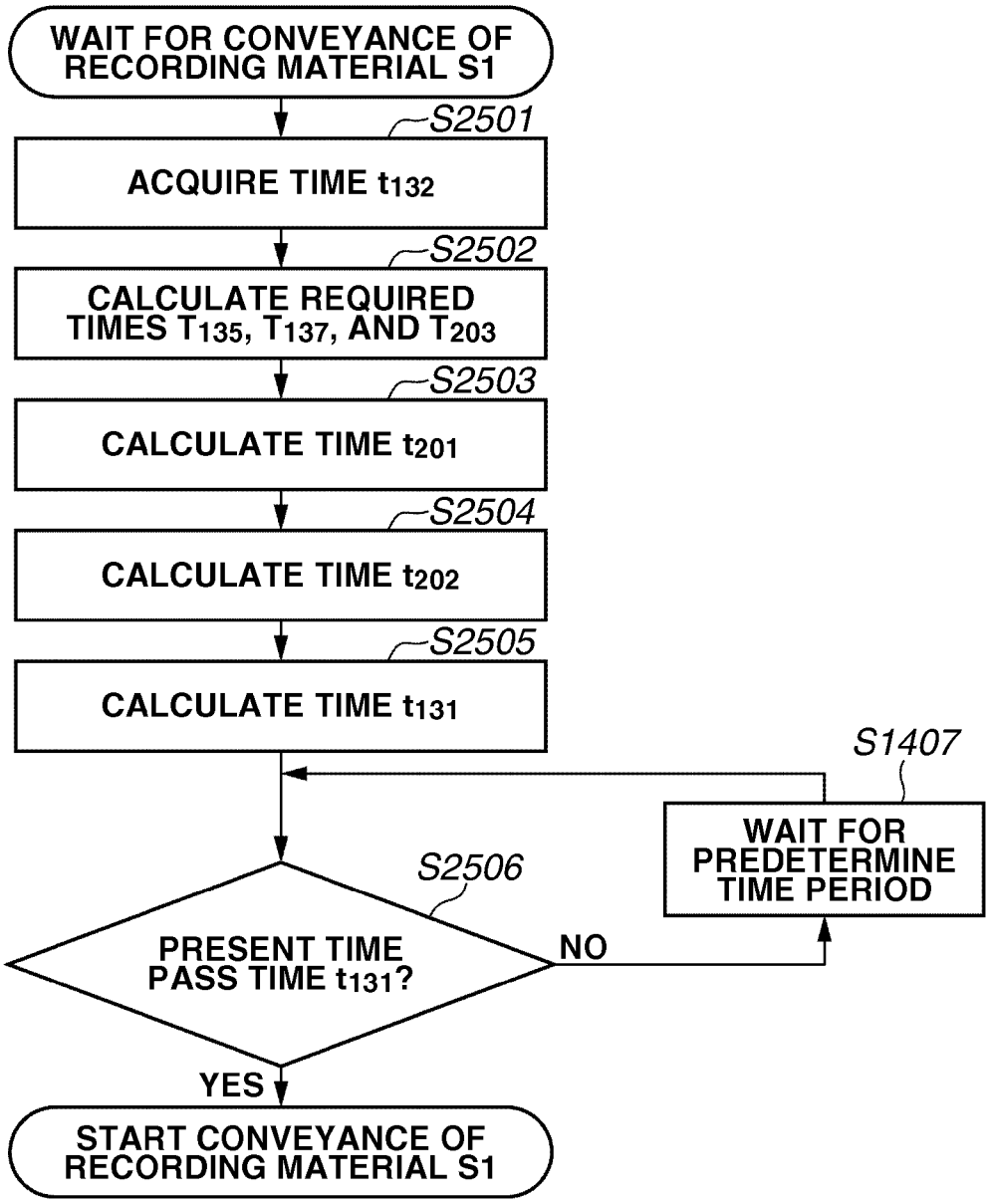
FIG. 14 is a flowchart illustrating an operation of the CPU according to the third exemplary embodiment.

The processing by the CPU 801 for determining whether conveyance of the recording material S1 is started will be described with reference to FIG. 14. Basic control is similar to that in the first exemplary embodiment. Steps having the same processing as those in the first exemplary embodiment illustrated in FIG. 7 are assigned the same step numbers, and redundant descriptions thereof will be omitted. The points different from the first exemplary embodiment will be described. In step S2501, by using a similar method to that in the first exemplary embodiment, the CPU 801 acquires the time $t_{132}$ when the document sheet G2 starts to be conveyed in the document conveyance path 84, which is known information. In step S2502, similar to the first exemplary embodiment, the CPU 801 calculates the required time $T_{135}$ from the time when the recording material S1 starts to be conveyed in the recording material conveyance path 83 to the time when the recording material S1 starts passing the conveyance roller pair 41. Similar to the first and second exemplary embodiments, the CPU 801 calculates the required time $T_{137}$ from the time when the document sheet G2 starts to be conveyed in the document conveyance path 84 to the time when the document sheet G2 starts passing the conveyance roller pair 41, and the required time $T_{203}$ since the time when the document sheet G2 starts passing the conveyance roller pair 41 till the time when the document sheet G2 has passed the conveyance roller pair 41.

In step S2503, the CPU 801 adds the required times $T_{137}$ and $T_{203}$ to the time $t_{132}$ to calculate the time $t_{201}$ when the document sheet G has passed the conveyance roller pair 41 ($t_{201}=t_{132}+T_{137}+T_{203}$). As described above, it is necessary to control the time when the recording material S1 restarts to be conveyed so that the time $t_{202}$ when the recording material S1 starts passing the conveyance roller pair 41 is later than the time $t_{201}$. In step S2504, therefore, the CPU 801 calculates the time $t_{202}$ that satisfies $t_{201} \leq t_{202}$. In step S2505, the CPU 801 subtracts from the time $t_{202}$ (calculated in step S2504) the required time $T_{135}$ (calculated in S2502) to calculate the time $t_{131}$ when the recording material S1 starts to be conveyed in the recording material conveyance path 83 ($t_{131}=t_{202}-T_{135}$).

In step S2506, referring to a timer (not illustrated), the CPU 801 determines whether the present time has passed the time $t_{131}$. When the CPU 801 determines that the present time has not yet passed the time $t_{131}$ (NO in step S2506), the CPU 801 waits for a predetermined period of time in step S1407, and the processing returns to step S2506. On the other hand, when the CPU 801 determines that the present time has passed the time $t_{131}$ (YES in step S2506), the CPU 801 starts conveyance of the recording material S1. This completes descriptions of the processing by the CPU 801 for determining whether conveyance of the recording material S1 is started.

According to the configuration of the present exemplary embodiment, the CPU 801 stores information about the time $t_{132}$ when the document sheet G2 starts to be conveyed in the document conveyance path 84 with reference to the printing start time, and uses the information to calculate the time $t_{131}$ when the recording material S1 starts to be conveyed in the recording material conveyance path 83. However, it is also possible to provide a sensor in the middle of the conveyance path of the document sheet G2, and calculate the time $t_{131}$ based on the time when the document sheet G2 has passed the sensor. In addition, according to the configuration of the present exemplary embodiment, the CPU 801 suspends the recording material S1 being pinched by the discharge roller pair 60 during conveyance, and controls the time $t_{131}$ when the recording material S1 subsequently starts to be conveyed in the recording material conveyance path 83. However, the present exemplary embodiment may be implemented with a configuration in which the CPU 801 controls the time when the recording material S1 starts to be supplied from the first sheet feed unit 30.

According to the configuration of the present exemplary embodiment, conveyance timing control for conveying the recording material S1 in the recording material conveyance path 83 can be performed. As a result, the conveyance order and the conveyance interval of the document sheet G and the recording material S can be accurately controlled. Thus, it is possible to achieve a process of two-sided reading of image information of a plurality of document sheets G and continuous two-sided printing of the read image information on a plurality of recording materials S with high productivity, without requiring a complicated apparatus configuration. As described above, according to the present exemplary embodiment, it is possible to prevent degradation of the productivity in a case where a document reading operation and a printing operation are performed in parallel based on a configuration in which a document reading unit is provided in the middle of a recording material conveyance path.

In the third exemplary embodiment, the document sheet G passes through the common conveyance path 85 earlier than the recording material S, and the timing for conveying the document sheet G in the common conveyance path 85 is adjusted only with the relevant recording material conveyance start time. A fourth exemplary embodiment differs from the first exemplary embodiment in that the recording material S passes through the common conveyance path 85 earlier than the document sheet G, and the conveyance timing for the common conveyance path 85 is adjusted with both the relevant recording material conveyance speed and the relevant recording material conveyance start time. The overall configuration and the control unit 1500 of the image forming apparatus 1 are similar to those in the above-described configurations, and detailed descriptions thereof will be omitted.

<Conveyance Timing Control for Recording Material Conveyance in Common Conveyance Path>

A conveyance timing control method for conveying the recording material S G in the common conveyance path 85 when performing two-sided reading of image information of a plurality of document sheets G and continuous two-sided printing of the read image information on a plurality of recording materials S, will be described. Also in the present exemplary embodiment, when a plurality of recording materials S or document sheets G exists, a similar designation rule to that in the first exemplary embodiment is applied in descriptions to distinguish each of the plurality of recording materials S or document sheets G.

The order of conveyance of the document sheets G and the recording materials S in the common conveyance path 85 according to the present exemplary embodiment is similar to the order of conveyance illustrated in FIG. 8B. The document sheets G and the recording materials S are conveyed in order of the document sheet G1, the document sheet G2, the recording material S1, document sheet G3, the recording material S2, the document sheet G4, and so on. In the second exemplary embodiment, the document sheets G and the recording materials S are conveyed in order of a combination of the document sheet G2 and the recording material S1, a combination of the document sheet G3 and the recording material S2, and so on. In the present exemplary embodiment, the recording material S is conveyed in the common conveyance path 85 earlier than the document sheet G, i.e., in order of a combination of the recording material S1 and the document sheet G3, a combination of the recording material S2 and the document sheet G4, and so on. The CPU 801 continuously performs reading of the document sheets G and image formation on the recording materials S while alternately conveying the document sheets G and the recording materials S in the above-described order. The present exemplary embodiment is characterized in controlling both the relevant recording material conveyance start time and the relevant conveyance speed of the recording material S to achieve this conveyance control.

Operations performed according to the present exemplary embodiment will be described below particularly focusing on conveyance order control for the recording material S1 and the document sheet G3 out of conveyance order control for the document sheets G and the recording materials S. Therefore, in the following descriptions, subsequent operations will be described in detail below on the premise that two-sided reading of the document sheet G1 is completed, the first side (front side) of the document sheet G2 has been read, and the second side (back side) of the document sheet G1 has been printed on one side of the recording material S1.

Figure 15A:
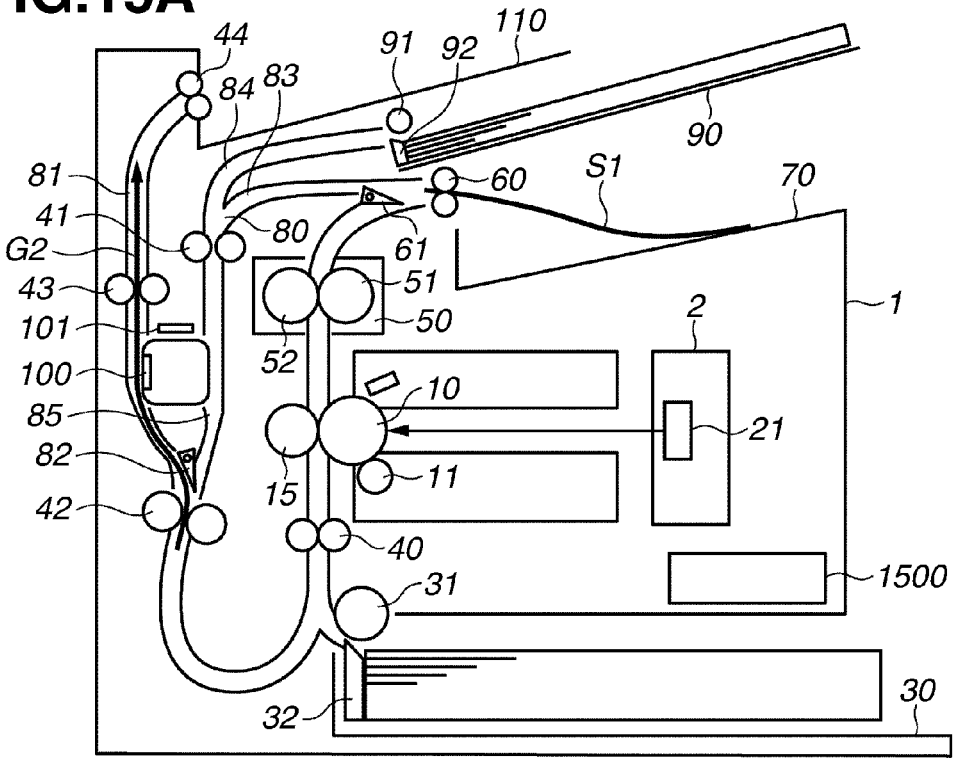
FIG. 15A illustrates a state where a recording material is ready for conveyance.

FIG. 15A illustrates a state where the recording material S1 is ready for conveyance. After printing is made on the second side (back side), the recording material S1 is conveyed toward the first discharge unit 70, and then suspended while being pinched by the discharge roller pair 60. Then, the recording material S1 waits till the time when the recording material S1 starts to be conveyed in the recording material conveyance path 83 calculated by the CPU 801 (described below). The time when the recording material S1 starts to be conveyed in the recording material conveyance path 83 refers to the time when, during conveyance of the recording material S1 from the discharge roller pair 60 through the recording material conveyance path 83 toward the common conveyance path 85, collision between the recording material S1 and the document sheet G3 in the common conveyance path 85 can be avoided. The time when the recording material S1 starts to be conveyed in the recording material conveyance path 83 refers to the time when it becomes possible for the document sheet G3 to be conveyed by following the trailing edge of the recording material S1. The document sheet G2 moves in the document conveyance path 81, and advances toward the second discharge unit 110. The image reading unit 100 reads image information of the second side (back side) of the document sheet G2, and stores the read image information in the image memory 804.

Figure 15B:
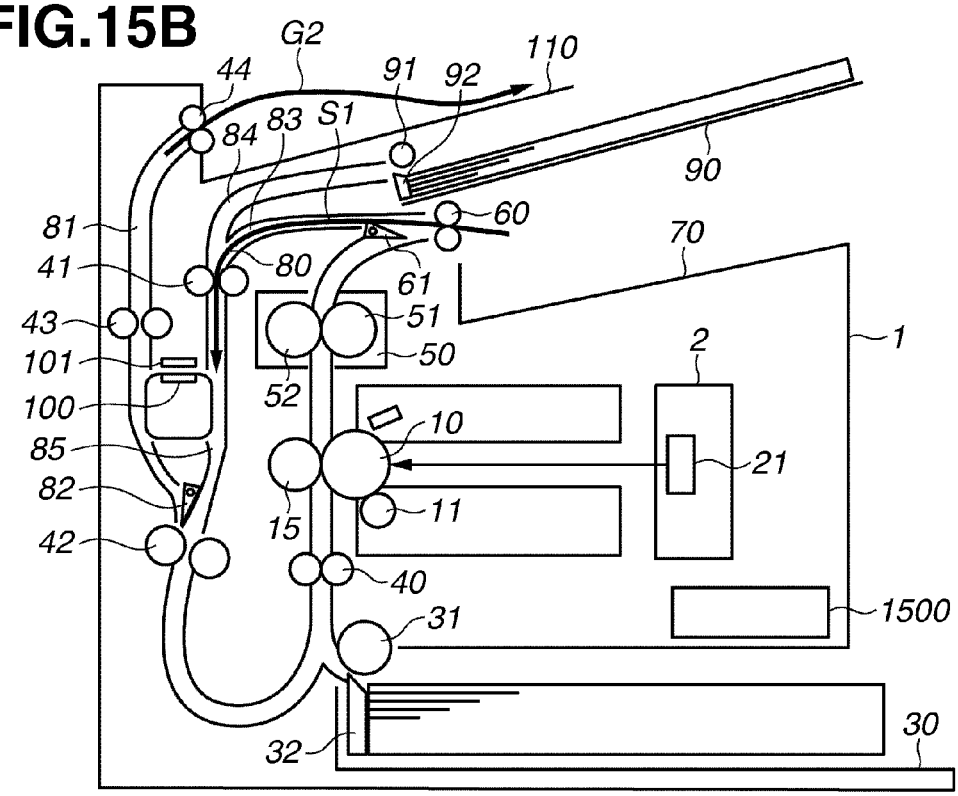
FIG. 15B illustrates an operation of the recording material to enter the two-sided conveyance path.

FIG. 15B illustrates an operation of the recording material S1 to enter the common conveyance path 85. When time has elapsed, and the time when the recording material S1 starts to be conveyed in the recording material conveyance path 83 comes, the recording material S1 is conveyed in the recording material conveyance path 83 while being pinched by the discharge roller pair 60, and then enters the common conveyance path 85. The document sheet G2 is discharged onto the second discharge unit 110. When the recording material S1 is conveyed at the conveyance speed Vp1, the conveyance speed Vp1 is adjusted to a conveyance speed at which the document sheet G3 can be conveyed by following the trailing edge of the recording material S1 while avoiding collision between the recording material S1 and the document sheet G3 in the common conveyance path 85.

Figure 15C:
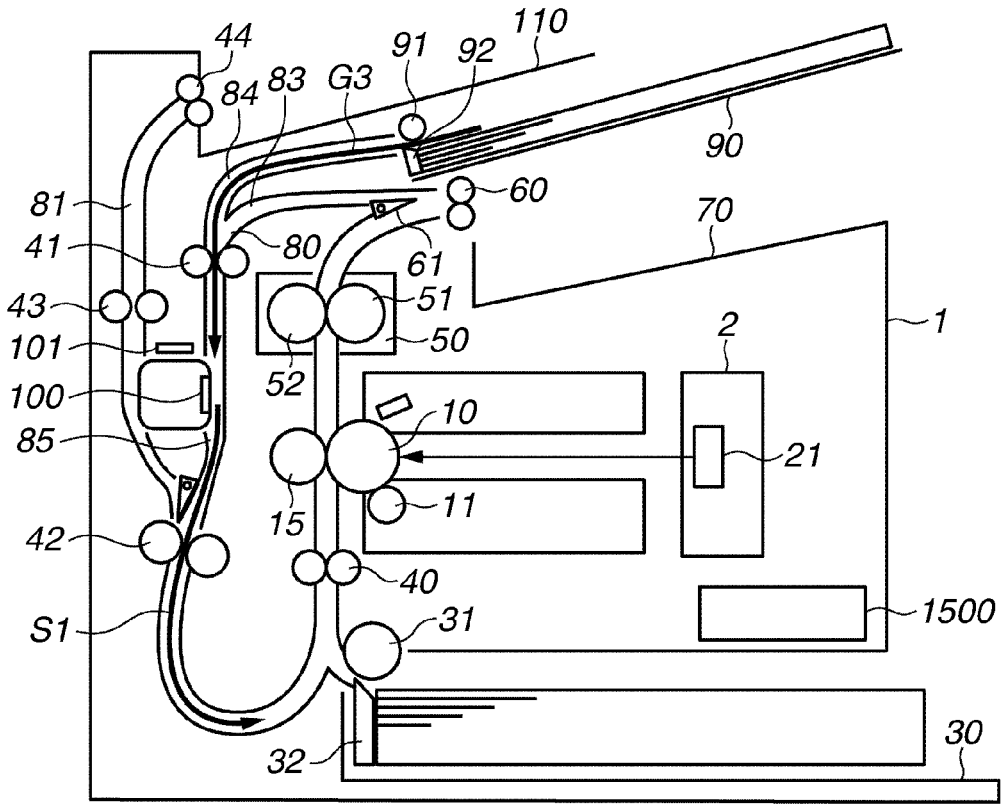
FIG. 15C illustrates a recording material conveyance operation in the two-sided conveyance path, according to the fourth exemplary embodiment.

FIG. 15C illustrates a conveyance operation for the recording material S1. The document sheet G3 starts to be conveyed from the second sheet feed unit 90 through the document conveyance path 84 toward the common conveyance path 85 by the document pickup roller 91 and the separation member 92. When the document sheet G3 enters the common conveyance path 85, the document sheet G3 is pinched by the conveyance roller pair 41. When the leading edge of the document sheet G3 is pinched by the conveyance roller pair 41, the trailing edge of the recording material S1 has already passed the conveyance roller pair 41. Then, the document sheet G3 and the recording material S1 are conveyed in the common conveyance path 85 with a sufficient conveyance interval therebetween so that the document sheet G3 and the recording material S1 do not collide with each other. On the other hand, by the time when the document sheet G3 enters the common conveyance path 85 and reading of the first side (front side) of the document sheet G3 is started, the document reading unit 100 completes preparation for document reading to prepare for reading the document sheet G3. While the document sheet G3 is passing the document reading unit 100, the document reading unit 100 reads image information of the first side (front side) of document sheet G3, and stores the read image information in the image memory 804.

The document sheet G3 is conveyed in the document conveyance path 84 at the conveyance speed Vs1, and conveyed in the common conveyance path 85 at the conveyance speed Vs2. Similar to the third exemplary embodiment, the conveyance speeds Vs1 and Vs2 are controlled based on the optimum conveyance speed for document reading. However, in the present exemplary embodiment, to avoid collision between the recording material S1 and the document sheet G3 in the common conveyance path 85, the CPU 801 controls both the time when the recording material S1 starts to be conveyed in the recording material conveyance path 83, and the conveyance speed of the recording material S1 in the recording material conveyance path 83. More specifically, the CPU 801 controls the timing for starting conveyance of the recording material S1 from the reversing start position, and controls the conveyance speed Vp1 of the recording material S1 during conveyance from the reversing start position to the common conveyance path 85. Subsequently, the CPU 801 reads the second side (back side) of document sheet G3, and prints the first side (front side) of the document sheet G1 on the recording material S1. However, subsequent operations are performed in the above-described process illustrated in FIGS. 2C and 2E, and detailed descriptions thereof will be omitted. This completes descriptions of a conveyance control method for conveying the recording material S in the common conveyance path 85 when performing two-sided reading of image information of a plurality of document sheets G and continuous two-sided printing of the read image information on a plurality of recording materials S.

<Descriptions of Recording Material and Document Conveyance Operations>

Figure 16:
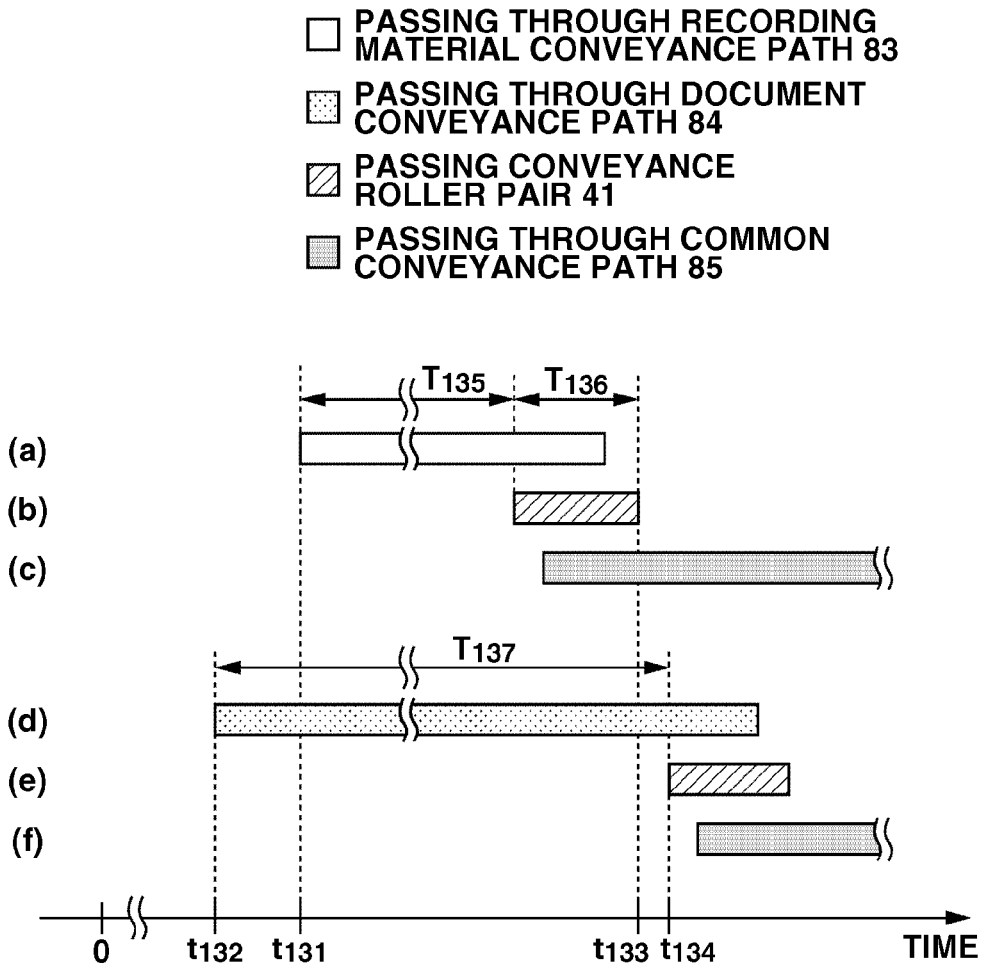
FIG. 16 is a timing chart illustrating recording material and document conveyance operations according to the fourth exemplary embodiment.

FIG. 16 is a timing chart illustrating conveyance operations for the recording material S1 and the document sheet G3. In the present exemplary embodiment, timings (d) to (f) indicate states of the document sheet G3. According to the configuration of the present exemplary embodiment, the time $t_{133}$ when the recording material S1 has passed the conveyance roller pair 41 precedes the time $t_{134}$ when the document sheet G3 starts passing the conveyance roller pair 41. The CPU 801 calculates the required times $T_{135}$, $T_{136}$, and $T_{137}$, and the times $t_{131}$, $t_{133}$, and $t_{134}$ based on the time $t_{132}$ when the document sheet G3 starts to be conveyed in the document conveyance path 84, the recording material conveyance speed Vp2, and the document conveyance speeds Vs1 and Vs2 which are known information. Other processing is similar to that in the above-described exemplary embodiments, and detailed descriptions thereof will be omitted.

<Processing for Determining Start of Recording Material Conveyance>

Figure 17:
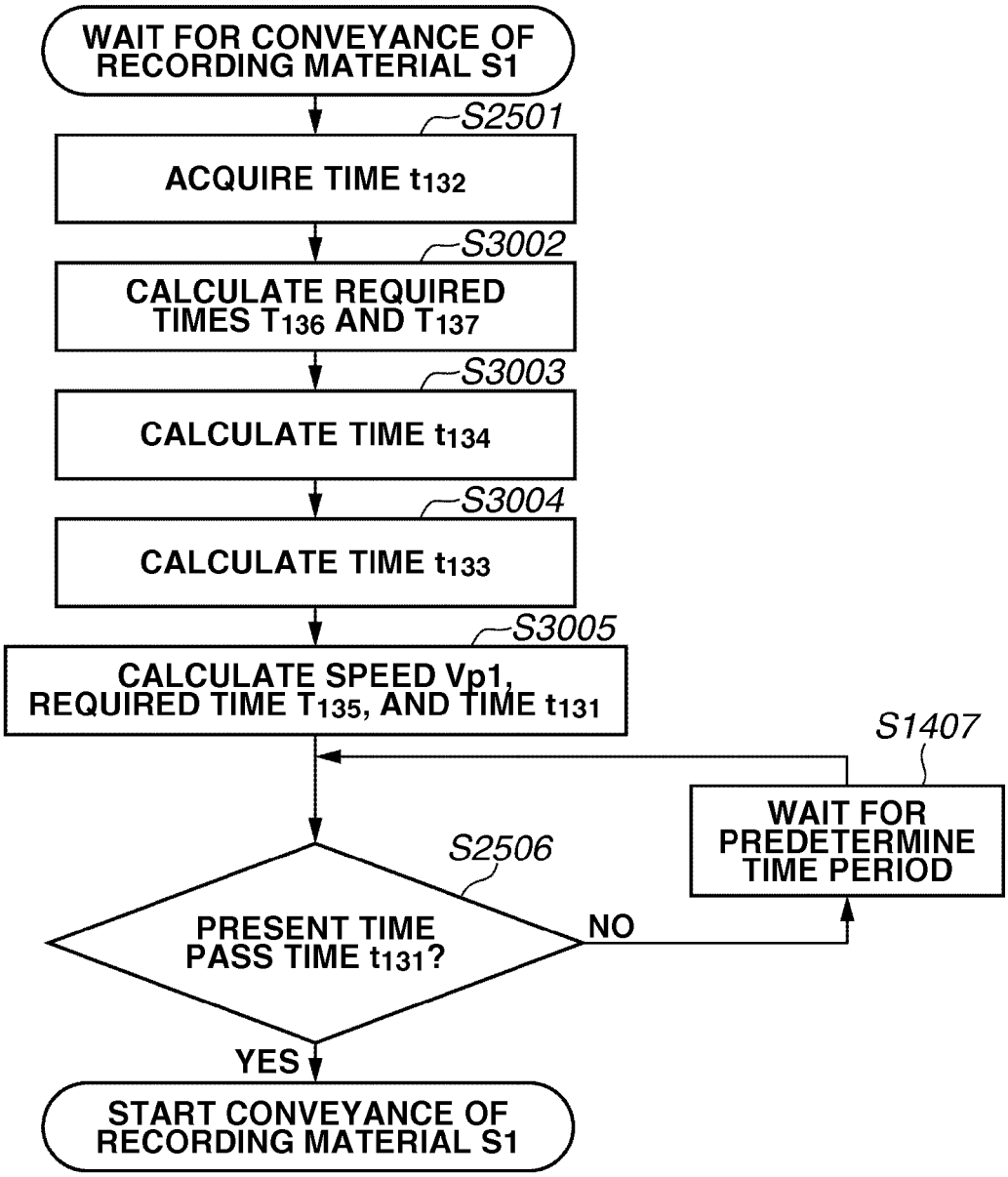
FIG. 17 is a flowchart illustrating an operation of the CPU according to the fourth exemplary embodiment.

The processing performed by the CPU 801 for determining whether conveyance of the recording material S1 is started will be described with reference to FIG. 17. Basic control is similar to that in the third exemplary embodiment. Steps having the same processing as those in the third exemplary embodiment illustrated in FIG. 14 are assigned the same step numbers, and redundant descriptions thereof will be omitted. The points different from the third exemplary embodiment will be described. Steps having the same processing as those in the first exemplary embodiment illustrated in FIG. 7 are assigned the same step numbers, and redundant descriptions thereof will be omitted. In step S3001, by using a similar method to that in the third exemplary embodiment, the CPU 801 acquires the time $t_{132}$ when the document sheet G3 starts to be conveyed in the document conveyance path 84, which is known information. In step S3002, the CPU 801 calculates the required time $T_{136}$ from the time when the recording material S1 starts passing the conveyance roller pair 41 to the time when the recording material S1 has passed the conveyance roller pair 41, and the required time $T_{137}$ from the time when the document sheet G3 starts to be conveyed in the document conveyance path 84 to the time when the document sheet G3 starts passing the conveyance roller pair 41. The CPU 801 calculates the required times $T_{136}$ and $T_{137}$ in a similar way to the first to third exemplary embodiments.

In step S3003, the CPU 801 adds the required time $T_{137}$ (calculated in step S3002) to the time $t_{132}$ to calculate the time $t_{134}$ when the document sheet G3 starts passing the conveyance roller pair 41 ($t_{134}=t_{132}+T_{137}$). As described above, it is necessary to control the time when the recording material S1 starts to be conveyed in the recording material conveyance path 83 so that the time $t_{133}$ when the recording material S1 has passed the conveyance roller pair 41 precedes the time $t_{134}$. In step S3004, therefore, the CPU 801 calculates the time $t_{133}$ that satisfies $t_{133} \leq t_{134}$. In step S3005, the CPU 801 calculates the conveyance speed Vp1, the required time $T_{135}$, and the time $t_{131}$ when the recording material S1 starts to be conveyed in the recording material conveyance path 83. In the present exemplary embodiment, it is necessary to perform control so that the time $t_{131}$ is later than the time $t_{132}$. In step S3005, the CPU 801 calculates the conveyance speed Vp1 adjusted so that the time $t_{131}$ is later than the time $t_{132}$, and then calculates the required time $T_{135}$ based on the calculated conveyance speed Vp1 and the conveyance path length between the discharge roller pair 60 and the conveyance roller pair 41. Then, the CPU 801 subtracts from the time $t_{133}$ the required time $T_{135}$ and the required time $T_{136}$ (calculated in step S3002) to calculate the time $t_{131}$ when the recording material S1 starts to be conveyed in the recording material conveyance path 83 ($t_{131}=t_{133}-T_{136}-T_{135}$). Subsequent processing is similar to that in the third exemplary embodiment, and redundant descriptions thereof will be omitted. This completes descriptions of the method for determining the conveyance timing for the recording material S1 performed by the CPU 801.

According to the configuration of the present exemplary embodiment, conveyance timing control and conveyance speed control for conveying the recording material S1 in the recording material conveyance path 83 can be performed. As a result, the conveyance order and the conveyance interval of the document sheet G and the recording material S can be accurately controlled. The CPU 801 adjusts both the time $t_{131}$ when the recording material S1 starts to be conveyed and the conveyance speed Vp1. Thus, it is possible to achieve a process of two-sided reading of image information of a plurality of document sheets G and continuous two-sided printing of the read image information on a plurality of recording materials S with higher productivity than in the third exemplary embodiment, without requiring a complicated apparatus configuration. As described above, according to the present exemplary embodiment, it is possible to prevent degradation of the productivity in a case where a document reading operation and a printing operation are performed in parallel based on a configuration in which a recording material and a document sheet share a common conveyance path.

Although the above-described exemplary embodiments premise a configuration of a monochrome image forming apparatus, the present invention is also applicable to a color image forming apparatus. The present invention is applicable to a color image forming apparatus in which photosensitive drums (image bearing members) for forming images of respective colors (yellow, magenta, cyan, and black) are arranged in a row, and images formed on the respective photosensitive drums are transferred onto a recording material or an intermediate transfer member. The present invention is also applicable to a color image forming apparatus in which images of respective colors are sequentially formed on one image bearing member (photosensitive drum), and a color image formed on an intermediate transfer member is transferred onto a recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-205856, filed Sep. 19, 2012, which is hereby incorporated by reference herein in its entirety.

What is claimed is:

1. An image forming apparatus comprising:

an image forming unit configured to form an image on a recording sheet;

a first conveyance path configured to convey the recording sheet so that the image is formed thereon by the image forming unit;

a second conveyance path configured to convey the recording sheet having the image formed on a first side thereof by the image forming unit, reverse the recording sheet, and re-convey the recording sheet having the image formed on the first side thereof to the first conveyance path;

a document sheet feed unit configured to feed a document sheet to the second conveyance path;

a reading unit configured to read a document image of the document sheet conveyed on the second conveyance path, wherein the document image is formed on the document sheet before the document sheet is fed by the document sheet feed unit;

a third conveyance path configured to convey, after a first side of the document sheet has been read in the second conveyance path, the document sheet, the first side thereof having been read in the second conveyance path; and a control unit configured to control, after the recording sheet has been conveyed to the first conveyance path so that the image is to be formed on the first side thereof and the recording sheet having the image formed on the first side thereof has been conveyed to the second conveyance path, the feeding operation of feeding the document sheet so that the document sheet is conveyed to the second conveyance path in such a manner that the document sheet does not overlap the recording sheet, while the recording sheet is being conveyed in the second conveyance path, wherein the control unit is also configured to control such that, in the third conveyance path, the reading unit reads a second side of the conveyed document sheet, and the recording sheet is conveyed to the second conveyance path while the document sheet is being conveyed in the third conveyance path.

2. The image forming apparatus according to claim 1, wherein the control unit controls a conveyance speed of the document sheet during conveyance from the document sheet feed unit to the second conveyance path.

3. The image forming apparatus according to claim 1, wherein the control unit controls timing for starting document sheet conveyance from the document sheet feed unit based on a conveyance position of the recording sheet having the image formed on the first side thereof.

4. A method for an image forming apparatus having a first conveyance path configured to convey a recording sheet so that an image is formed thereon by an image forming unit, a second conveyance path configured to convey the recording sheet having the image formed on a first side thereof by the image forming unit, reverse the recording sheet, and re-convey the recording sheet having the image formed on the first side thereof to the first conveyance path, and a third conveyance path configured to convey, after a first side of the document sheet has been read in the second conveyance path, the document sheet, the first side thereof having been read in the second conveyance path, the method comprising:

forming, via the image forming unit, an image on a recording sheet;

feeding, via a document sheet feed unit, a document sheet to the second conveyance path;

reading a document image of the document sheet conveyed on the second conveyance path, wherein the document image is formed on the document sheet before the document sheet is fed by the document sheet feed unit;

controlling, after the recording sheet has been conveyed to the first conveyance path so that the image is to be formed on the first side thereof and the recording sheet having the image formed on the first side thereof has been conveyed to the second conveyance path, the feeding operation of feeding the document sheet, so that the document sheet is conveyed to the second conveyance path in such a manner that the document sheet does not overlap the recording sheet, while the recording sheet is being conveyed in the second conveyance path, wherein controlling includes controlling such that, in the third conveyance path, a second side of the conveyed document sheet is read, and the recording sheet is conveyed to the second conveyance path while the document sheet is being conveyed in the third conveyance path.

5. The method according to claim 4, wherein controlling includes controlling a conveyance speed of the document sheet during conveyance from the document sheet feed unit to the second conveyance path.

6. The method according to claim 4, wherein controlling includes controlling timing for starting document sheet conveyance from the document sheet feed unit based on a conveyance position of the recording sheet having the image formed on the first side thereof.

7. The method according to claim 4, wherein controlling includes controlling timing for conveying the recording sheet to the second conveyance path when the recording sheet having the image formed on the first side thereof is reversed.

8. The method according to claim 4, wherein controlling includes controlling timing for feeding the document sheet to the second conveyance path by the document sheet feed unit.

9. The method according to claim 4, wherein controlling includes controlling the reading and the image forming unit such that the image forming unit forms, on a recording sheet, a document image read by the reading.

* * * * *